US008850779B2

(12) United States Patent
Pandurangan et al.

(10) Patent No.: US 8,850,779 B2
(45) Date of Patent: Oct. 7, 2014

(54) ICE BAGGING SYSTEM

(75) Inventors: Vijayakumar Pandurangan, Tamil Nadu (IN); David Makowski, Chicago, IL (US)

(73) Assignee: International Ice Bagging Systems, LLC, Chicago, IL (US)

( * ) Notice: Subject to any disclaimer, the term of this patent is extended or adjusted under 35 U.S.C. 154(b) by 902 days.

(21) Appl. No.: 13/013,496

(22) Filed: Jan. 25, 2011

(65) Prior Publication Data

US 2012/0186202 A1 Jul. 26, 2012

(51) Int. Cl.

| | |
|---|---|
| ***B65B 43/26*** | (2006.01) |
| ***B65B 43/30*** | (2006.01) |
| ***B65B 43/12*** | (2006.01) |
| ***B65B 25/00*** | (2006.01) |
| *F25C 5/00* | (2006.01) |

(52) U.S. Cl.

CPC ..... *B65B 43/123* (2013.01); *B65B 25/001* (2013.01); *F25C 5/002* (2013.01)

USPC ..... 53/384.1; 53/235; 53/381.1; 53/570

(58) Field of Classification Search

CPC ..... B65B 43/26; B65B 43/30; B65B 43/46; B65B 43/465

USPC ..... 53/235, 381.1, 384.1, 459, 570

See application file for complete search history.

(56) References Cited

U.S. PATENT DOCUMENTS

| | | | | | |
|---|---|---|---|---|---|
| 1,448,713 | A | | 3/1923 | Pool | |
| 2,702,150 | A | * | 2/1955 | Vogt | 53/570 |
| 3,132,847 | A | | 5/1964 | Mercuriali | |
| 3,746,057 | A | * | 7/1973 | Titchenal | 141/114 |
| 4,169,345 | A | * | 10/1979 | Douwenga | 53/570 |
| 4,244,159 | A | * | 1/1981 | Gess | 53/567 |
| 4,423,583 | A | * | 1/1984 | Carey | 52/373 |
| 4,516,384 | A | * | 5/1985 | Imperiale | 53/459 |
| 4,586,319 | A | * | 5/1986 | Ausnit | 53/468 |
| 5,109,651 | A | | 5/1992 | Stuart | |
| 5,115,619 | A | * | 5/1992 | Lieder | 53/459 |
| 5,142,841 | A | * | 9/1992 | Cappi et al. | 53/384.1 |
| 5,179,816 | A | * | 1/1993 | Wojnicki | 53/133.4 |
| 5,440,863 | A | | 8/1995 | Toya et al. | |
| 5,477,896 | A | | 12/1995 | Grifols Lucas | |
| 5,581,982 | A | | 12/1996 | Schroeder et al. | |
| 5,630,310 | A | | 5/1997 | Chadwell | |
| 5,664,406 | A | * | 9/1997 | Smith | 53/459 |
| 5,687,833 | A | | 11/1997 | Dalessio, Jr. et al. | |

(Continued)

OTHER PUBLICATIONS

International Search Report for International Application No. PCT/US2012/22556, dated May 16, 2012.

(Continued)

*Primary Examiner* — Gloria R Weeks

(74) *Attorney, Agent, or Firm* — Marshall, Gerstein & Borun LLP

(57) ABSTRACT

An ice bagging system includes an ice maker unit, an ice bagger unit, and an ice storing unit. The ice bagger unit includes a sheet of ice bags disposed on a bag roll, the sheet of ice bags is threaded through a plurality of guide rollers, a pinch roller assembly, and a sealing jaw assembly. The pinch roller assembly includes first and second pinch roller wheels that are axially movable inwardly and outwardly to selectively open or close an individual ice bag in the sheet of ice bags.

18 Claims, 36 Drawing Sheets

(56) References Cited

U.S. PATENT DOCUMENTS

| | | | | |
|---|---|---|---|---|
| 5,708,223 | A | 1/1998 | Wyss | |
| 5,822,955 | A | 10/1998 | Woosley et al. | |
| 6,094,895 | A * | 8/2000 | Ravizza | 53/567 |
| 6,112,539 | A | 9/2000 | Colberg | |
| 6,134,864 | A * | 10/2000 | McGregor et al. | 53/459 |
| 6,148,587 | A * | 11/2000 | McDonald et al. | 53/255 |
| 6,266,945 | B1 | 7/2001 | Schroeder | |
| 6,457,298 | B1 * | 10/2002 | Schwenke et al. | 53/459 |
| 6,474,048 | B1 | 11/2002 | Metzger et al. | |
| 6,571,573 | B1 | 6/2003 | Henry | |
| 6,685,053 | B2 | 2/2004 | Hawkes et al. | |
| 6,742,321 | B2 * | 6/2004 | Gates | 53/570 |
| 6,788,218 | B2 | 9/2004 | Sudolcan | |
| 6,827,529 | B1 | 12/2004 | Berge et al. | |
| 6,877,543 | B2 * | 4/2005 | Stevens | 156/581 |
| 6,894,232 | B2 | 5/2005 | Waggoner et al. | |
| 6,904,946 | B2 | 6/2005 | James | |
| 6,925,335 | B2 | 8/2005 | May et al. | |
| 6,932,124 | B2 | 8/2005 | Dalton et al. | |
| 7,062,892 | B2 | 6/2006 | Metzger | |
| 7,104,291 | B2 | 9/2006 | Dalton et al. | |
| 7,137,271 | B2 | 11/2006 | Hawkes et al. | |
| 7,139,616 | B2 | 11/2006 | May et al. | |
| 7,207,156 | B2 | 4/2007 | Metzger | |
| 7,310,957 | B2 | 12/2007 | Broadbent et al. | |
| 7,421,834 | B1 | 9/2008 | Doolan | |
| 7,426,812 | B2 | 9/2008 | Metzger | |
| 7,426,945 | B2 | 9/2008 | Dalton et al. | |
| 7,497,062 | B2 | 3/2009 | Metzger | |
| 7,611,102 | B2 * | 11/2009 | Murray | 248/101 |
| 7,624,773 | B2 | 12/2009 | Maxwell | |
| 7,810,301 | B2 * | 10/2010 | Metzger | 53/459 |
| 7,849,660 | B2 | 12/2010 | Metzger | |
| 8,132,392 | B2 | 3/2012 | Metzger | |
| 8,468,783 | B2 * | 6/2013 | Uebler et al. | 53/457 |
| 8,468,784 | B2 | 6/2013 | Metzger | |
| 8,739,557 | B2 | 6/2014 | Metzger | |
| 8,763,352 | B2 | 7/2014 | Metzger | |
| 2006/0196152 | A1 * | 9/2006 | Wild et al. | 53/459 |
| 2007/0240441 | A1 | 10/2007 | Hobson et al. | |
| 2007/0267086 | A1 | 11/2007 | Dunn | |
| 2008/0022635 | A1 | 1/2008 | Metzger | |
| 2008/0110129 | A1 | 5/2008 | LeBlanc et al. | |
| 2008/0125882 | A1 | 5/2008 | Broadbent et al. | |
| 2008/0196788 | A1 | 8/2008 | Dalton et al. | |
| 2008/0245438 | A1 | 10/2008 | Ladson | |
| 2008/0245439 | A1 | 10/2008 | Ladson | |
| 2008/0295462 | A1 | 12/2008 | Metzger | |
| 2009/0120039 | A1 | 5/2009 | Metzger | |
| 2010/0011706 | A1 | 1/2010 | Paine | |
| 2010/0011710 | A1 * | 1/2010 | Pape | 53/450 |
| 2010/0024363 | A1 | 2/2010 | Pape | |
| 2010/0269458 | A1 * | 10/2010 | Veix | 53/570 |
| 2010/0313524 | A1 * | 12/2010 | Pape et al. | 53/459 |
| 2012/0096812 | A1 * | 4/2012 | Ejeblad et al. | 53/452 |
| 2013/0133296 | A1 | 5/2013 | Metzger | |
| 2013/0255194 | A1 | 10/2013 | Metzger | |

OTHER PUBLICATIONS

Written Opinion for International Application No. PCT/US2012/22556, dated May 16, 2012.

* cited by examiner

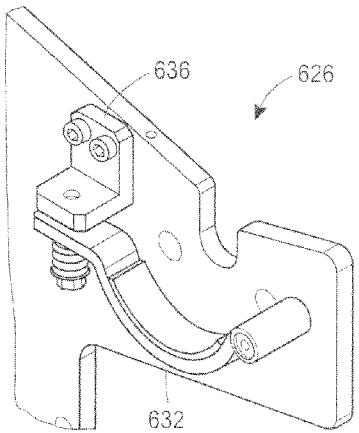
Fig. 11H
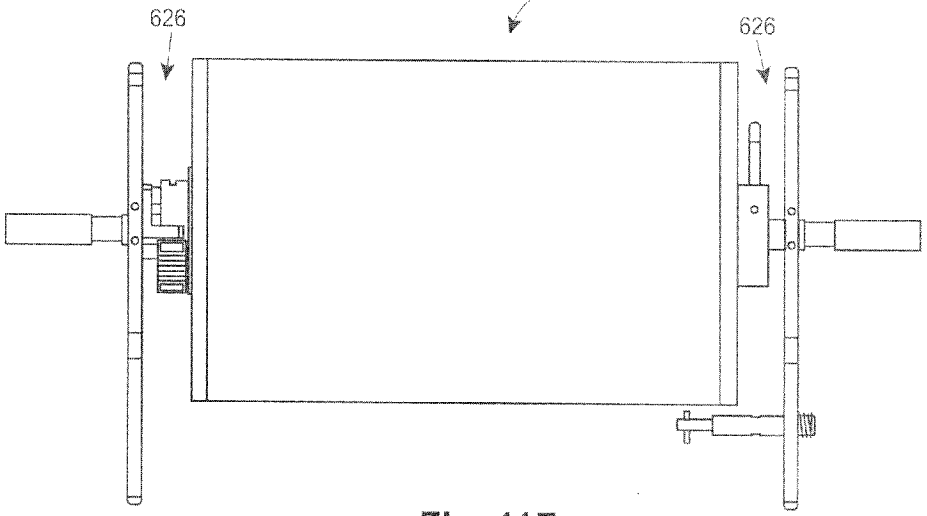
Fig. 11F
Fig. 11G
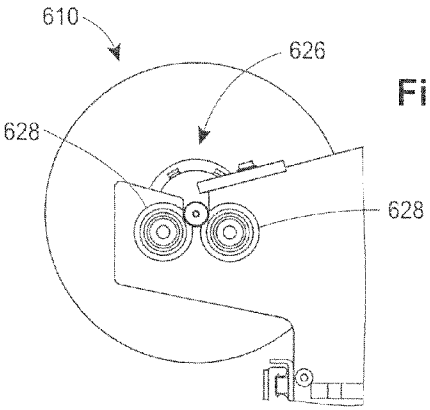

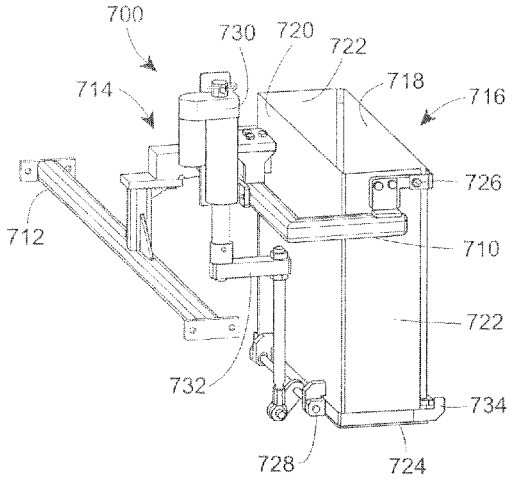
Fig. 15A
Fig. 15B
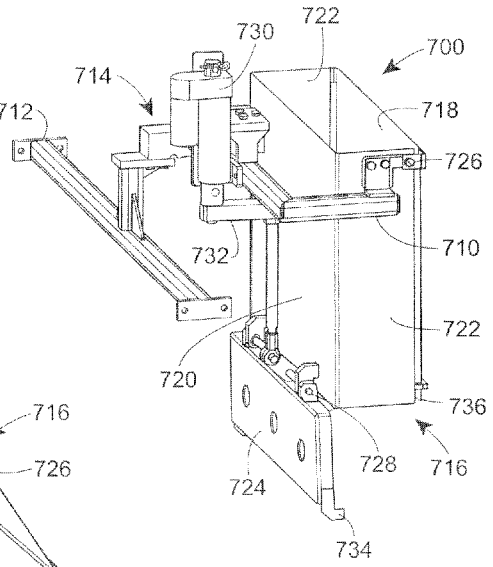
Fig. 15C
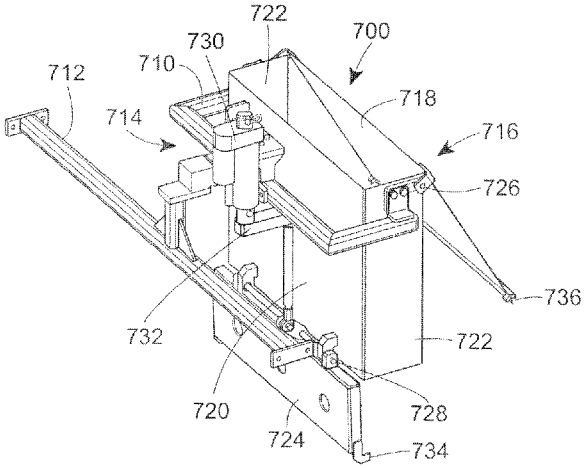

ICE BAGGING SYSTEM

BACKGROUND

1. Field of the Disclosure

The invention relates generally to ice bagging systems and specifically to ice bagging machines that have adjustable pinch rollers.

2. Related Technology

Ice is a very useful product for keeping consumables cold to preserve shelf life, or to lower the temperature of beverages for more enjoyable beverage consumption when portability is important. For example, ice may be used to keep beverages cold in a cooler for sporting events or other outings. Often, consumers purchase bags of ice of various weights from retail locations for the above stated reasons.

One method of forming salable bags of ice is to manually load ice into individual bags. Thereafter, the bags of ice are sealed and transported to retail locations. Manually loading ice into bags is time consuming and expensive. Because ice is a common and easily manufactured product, consumers are not willing to pay a high premium for bags of ice when they can make their own ice at home.

Automatic ice bagging systems were developed to enhance efficiency and to increase bagging throughput of ice. Although these automatic ice bagging systems are improvements over manual ice bagging, existing automatic ice bagging systems suffer from inconsistent weights of ice in each bag. Known automatic ice bagging systems calculate the weight of ice in a bag by measuring the volume of ice delivered to the bag. Since ice is assumed to have a constant density, the weight of ice can be calculated by the volume of ice delivered to the bag. However, if the available volume of ice is insufficient to completely fill a bag, the known automatic ice bagging systems must wait for delivery of more ice from a cuber (i.e., an ice making machine). While the known automatic ice bagging systems wait for more ice, the ice already in the bag may begin to melt. As a result, some of the already measured volume of ice is lost, leading to an inaccurate weight of ice in the bag (e.g., less ice than should be in the bag). Known automatic ice bagging systems also suffer from incomplete bag sealing due to moisture on the inside of the bags in the sealing area due to melting ice. Finally, known automatic ice bagging systems are capable of only filling one size bag of ice. In other words, known automatic ice bagging systems can only fill a single size ice bag at a time, for example, a five pound bag.

SUMMARY OF THE DISCLOSURE

An ice bagging unit for an automatic ice bagging system includes a sheet of ice bags disposed on a bag roll, the sheet of ice bags is threaded through a plurality of guide rollers, a pinch roller assembly, and a sealing jaw assembly. The pinch roller assembly includes first and second pinch roller wheels that are axially movable inwardly and outwardly to selectively open or close an individual ice bag in the sheet of ice bags.

In another embodiment, the ice bagging unit may include a bag and release assembly having a retention bin. As ice fills an individual ice bag, a load cell on the bag and release assembly sends a signal to a controller indicative of the actual weight of ice in the ice bag. When the controller determines that a predetermined or set weight of ice is in the ice bag, the controller instructs a hopper to stop delivering ice to the bag and instructs the sealing jaw assembly to seal the bag opening. The amount of ice may be selectable for each individual bag in the sheet of ice bags through the controller.

BRIEF DESCRIPTION OF THE DRAWINGS

Objects, features, and advantages of the present invention will become apparent upon reading the following description in conjunction with the drawing figures.

FIGS. 11F-11H are close up side and perspective views, respectively, of a bag roller mounting slot in a frame of the ice bagger of FIG. 9.

FIG. 12 C is a side elevational view of the pinch roller assembly of FIGS. 12A and 12B.

FIGS. 15A-15C are isometric views of a basket and release assembly of the ice bagger of FIG. 9, in closed, bottom door open, and bottom door and front wall open positions, respectfully.

FIGS. 16A-16F are front isometric, rear isometric, end, side elevational, and top plan views, respectively, of the basket and release assembly of FIG. 15B.

DETAILED DESCRIPTION

Figure 1:
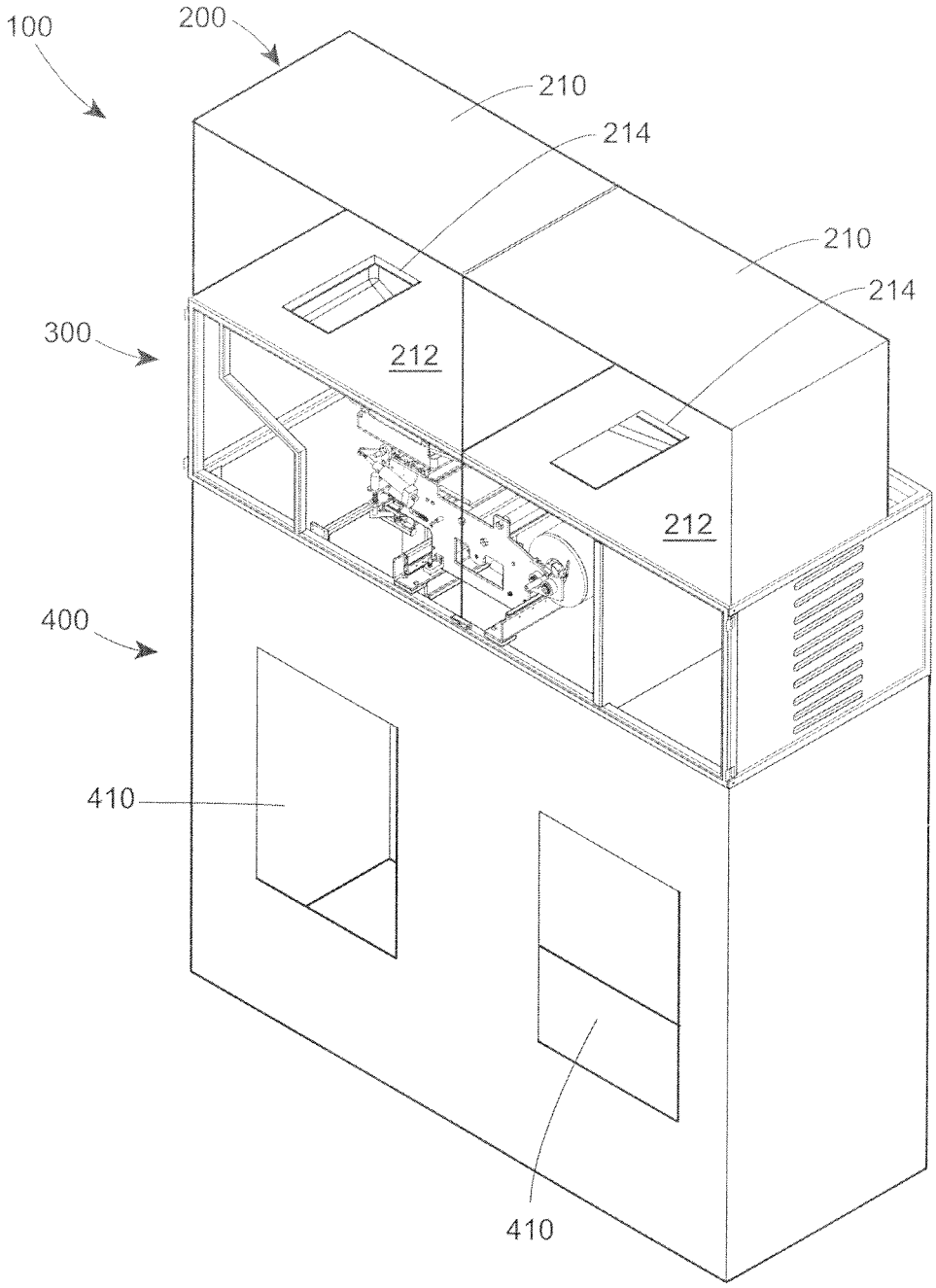
FIG. 1 is an isometric view of an ice bagging system constructed in accordance with the teachings of the disclosure.

A self contained ice bagging system 100 is illustrated in FIG. 1. The ice bagging system 100 may include an ice making unit 200, an ice bagging unit 300, and an ice storage unit 400. The ice making unit 200 may include one or more cubers or freezers 210 that produce ice, for example in the form of cubes or other shapes, as is known in the art. The freezers 210 may have similar ice making capacities. For example, the freezers 210 may each be capable of producing approximately 800 pounds of ice per day. In other embodiments, the freezers 210 may have different ice making capacities. For example one freezer 210 may be capable of producing approximately 800 pounds of ice per day while another freezer 210 may be capable of producing approximately 1200 pounds of ice per day. By mixing and matching freezers 210 with similar or different ice making capacities, the self contained ice bagging system 100 may be capable of virtually any total ice throughput. For example, the self contained ice bagging system 100 may be capable of producing and bagging 1300, 1600, 1900, 2400 or more pounds of ice per day. Of course, the self contained ice bagging system may only have a single freezer 210 if desired. In this way, the self contained ice bagging system 100 is customizable with respect to ice throughput based on user needs, thus improving efficiency of the overall ice bagging process.

The freezers 210 may be arranged adjacent one another with substantially coplanar bases 212. In other embodiments, the bases 212 need not be coplanar and the freezers 210 may be arranged on top of one another, or in virtually any other relative position. Ice produced in the ice making unit 200 is delivered to the ice bagging unit 300 through one or more openings 214 in the ice making unit 200. After ice is collected and bagged in the ice bagging unit 300, the bags of ice may be delivered to the ice storage unit 400 through openings (not shown) in the ice bagging unit 300 and/or openings (not shown) in the ice storage unit 400. Bags of ice in the ice storage unit 400 may be accessed through one or more doors or other openings 410 in the ice storage unit 400. The self contained ice bagging system 100 may be located in a retail store, for example, so that customers may select and remove one or more bags of ice from the ice storage unit 400 through the doors 410. Alternatively, the self contained ice bagging system 100 may be located in any manufacturing facility that needs bagged ice, or any other location having a need for bagged ice.

Advantageously, the disclosed self-contained ice bagging system 100 is capable of producing multiple ice bag sizes (i.e., different weights of ice per bag) without changing components. For example, the disclosed ice bagging system 100 is capable of changing from five pound bags of ice to ten pound bags of ice without interrupting the ice bagging process. Moreover, each individual bag of ice may be weight selectable by a user. For example, one user may select a five pound bag of ice and the very next user may select a ten pound bag of ice. A controller simply adjusts the weight of ice in each bag according to a weight measurement from the ice bagging unit to meet user needs. Thus, users may select exactly the amount of ice needed for a given situation resulting in less water waste and higher bagging efficiency. The disclosed high efficiency ice bagging system is generally better for the environment than previous systems because the high efficiency ice bagging system uses less energy and water than known systems.

Alternatively, the one or more components of the ice bagging system 100 could be changed to accommodate different bag sizes and or weights of ice. For example, a first roll of bags could be exchanged for a second roll of bags having larger or smaller bags than the first roll of bags. A first basket and release assembly could also be exchanged for a second larger or smaller basket and release assembly that is sized for the second roll of bags. When components of the ice bagging system 100 are exchanged, the change is facilitated by a compartmentalized, modular organization of system components. The compartmentalized, modular organization will be discussed further below.

Generally, the ice making unit 200 is located above the ice bagging unit 300, which is located above the ice storage unit 400 to take advantage of gravity to feed ice through the system. However, any one of the ice making unit 200, the ice bagging unit 300, and the ice storage unit 400 could be located separately from the other units if needed. Transportation devices such as conveyor belts or elevators may be used to deliver ice between the ice making unit 200, the ice bagging unit 300, and the ice storage unit 400, if needed for a particular location. The vertical orientation of the units illustrated in the figures may take on other arrangements and one of ordinary skill in the art would rearrange the components to suit particular needs.

The self contained ice bagging system 100 described herein is easy to maintain and repair because the ice making unit 200, the ice bagging unit 300, and the ice storage unit 400 are compartmentalized. Moreover, certain components of the ice making unit 200, the ice bagging unit 300, and the ice storage unit 400 may be mounted on slidable frames to allow rapid access to any part contained in the unit, as will be described further hereinafter. This modular and removable construction results in a system that is very easy to maintain and/or repair.

Figure 2:
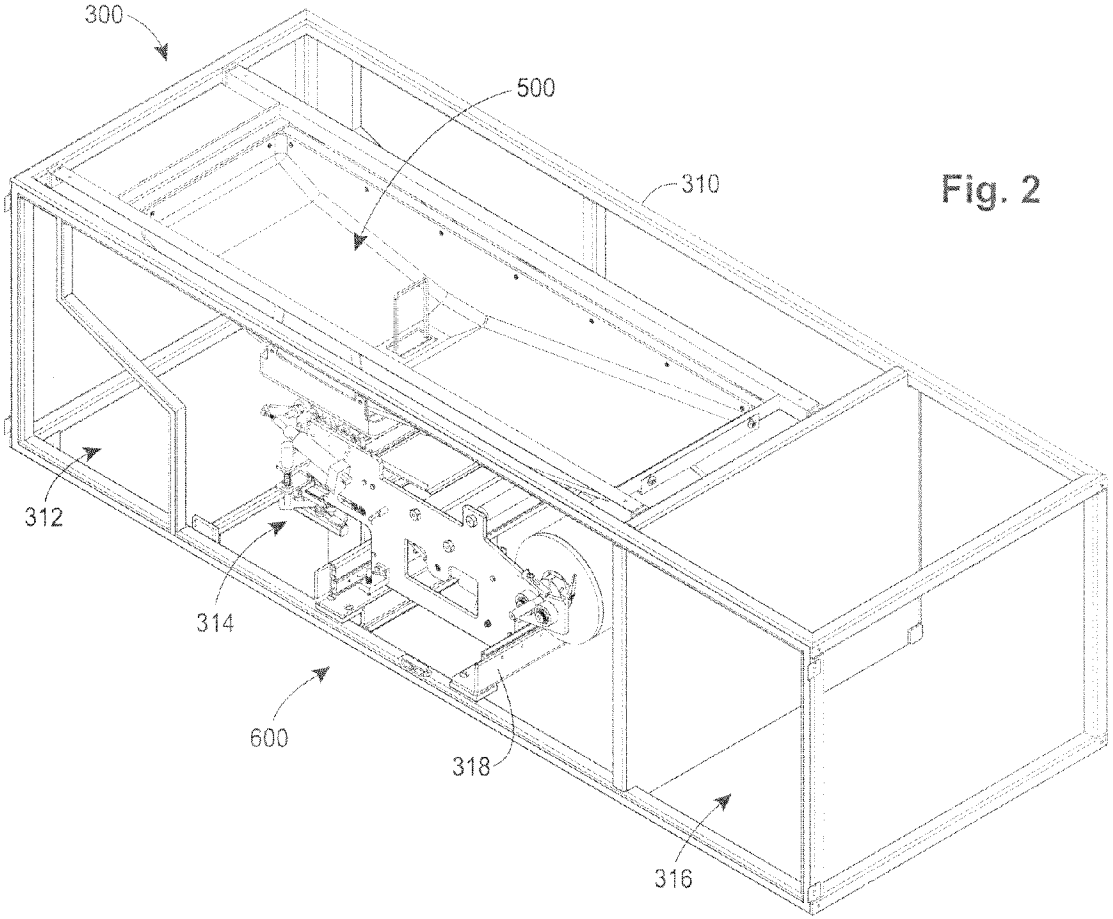
FIG. 2 is an isometric view of an ice bagging unit of the ice bagging system of FIG. 1.

FIG. 2 illustrates one embodiment of the ice bagging unit 300. The ice bagging unit 300 includes a frame 310 having a controls section 312, an ice bagger section 314, and a compressor section 316. The controls section 312 may house a processor or controller (not shown) that controls operation of the ice bagger 600, which is located in the ice bagger section 314. The controller may be operatively connected to an input device (not shown), such as a touch screen, so that a user may send instructions to the controller. The ice bagger 600 may be mounted on a removable means, such as slidable rails 318 or other similar device, so that the ice bagger 600 can slide at least partially out of the frame for easy access during service or maintenance. A sensor connected to the controller may detect the location of the frame so that the ice bagging unit 300 is only activated when the ice bagger 600 is fully disposed within the frame. A hopper 500 may be mounted in the ice bagger section 314, above the ice bagger 600 so that ice supplied from the ice maker unit 200 (FIG. 1) is directed by the hopper 500 into the ice bagger 600. The hopper 500 may also be mounted on a removable means so that the hopper 500 may slide partially out of the ice bagger section 314 for easy maintenance and repair. The compressor section 316 may house a compressor (not shown) that supplies cold fluid to the ice maker unit 200 (FIG. 1). The compressor may also cool the ice bagger section 314 to prevent ice from melting during the bagging process. The frame 310 may be covered with siding (see FIG. 1) to improve aesthetic appeal or to insulate the ice bagger 600, for units located in retail outlets, or the frame 310 may be left open for uses where aesthetic appearance is not important or where the unit is placed in a cold operating environment.

Figure 3:
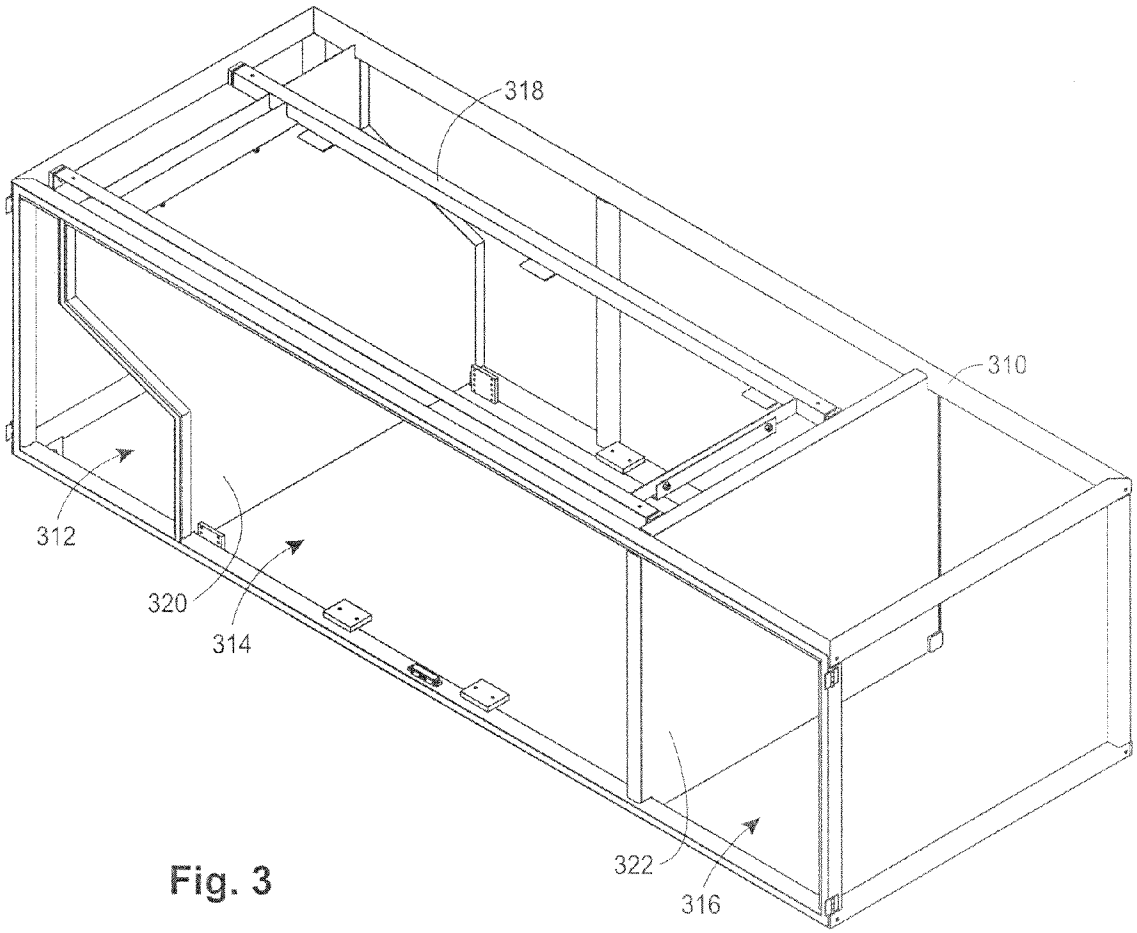
FIG. 3 is a side isometric view of a frame that supports the ice bagging unit of FIG. 2.

FIG. 3 illustrates the frame 310 without the ice bagger 600. The frame 310 may include one or more sub-frames 318 for securing either the hopper 500 or the ice bagger 600 within the frame 310. The frame 310 may also include one or more partitions 320, 322 to separate compartments within the frame 310. The partitions 320, 322 may be solid, as shown in FIG. 3, or the partitions 320, 322 may be permeable, such as screen or mesh. In other embodiments, the partitions 320, 322 may be eliminated altogether. However, in certain operations, the partitions 320, 322 may insulate the frame compartments from one another and/or increase overall rigidity of the frame 310.

Figures 4A, 4B:
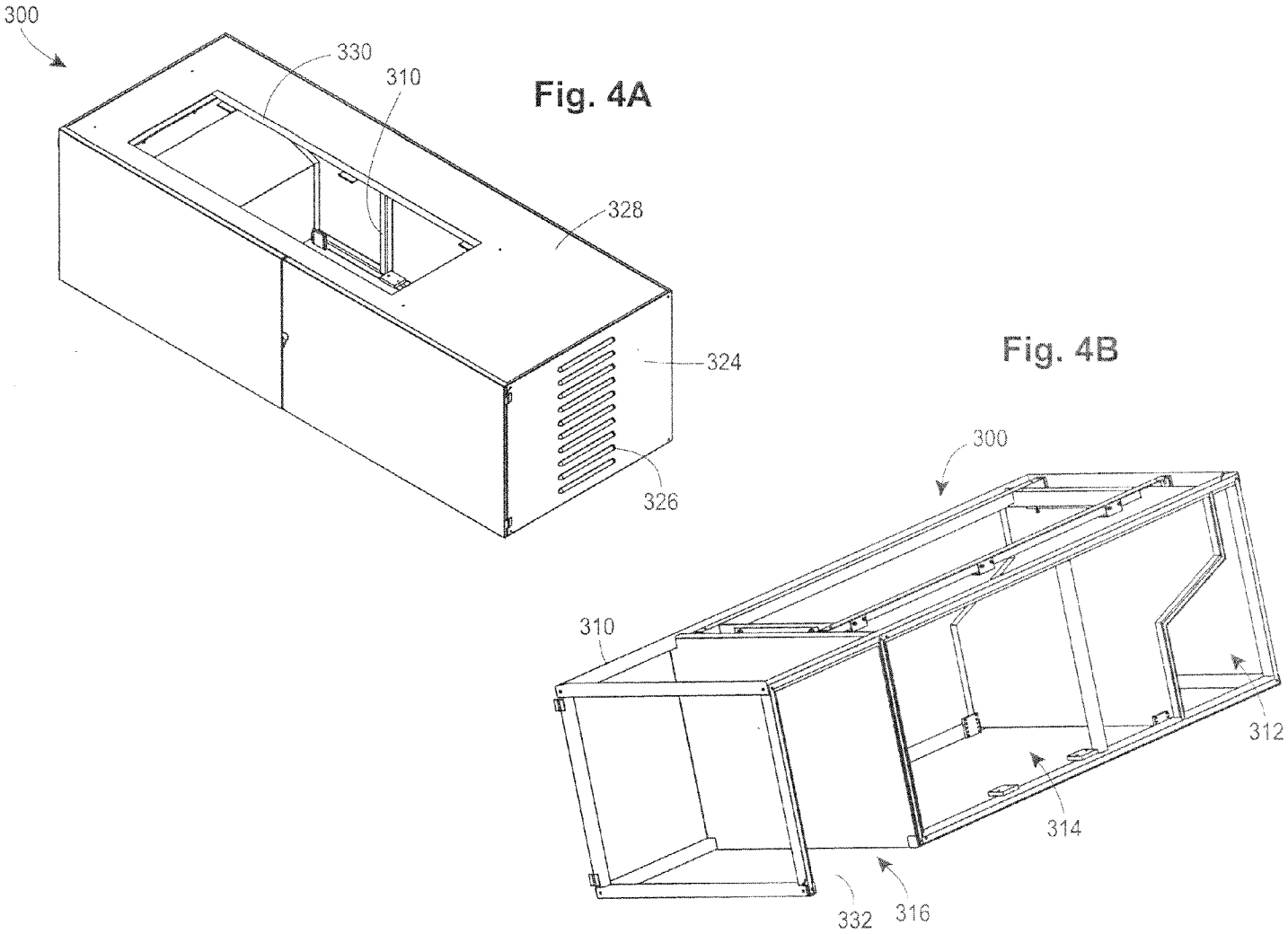
FIGS. 4A and 4B are top and rear isometric views, respectively, of the frame of FIG. 3 with an exterior covering and without an exterior covering.

FIG. 4A illustrates the frame 310 with siding 324 installed. The siding 324 may be installed on one or more sides of the frame 310 and may include vents 326 to provide cooling air to components within the frame, such as the compressor. An upper siding panel 328 may include an opening 330 through which ice from the ice making unit 200 is introduced into the hopper 500.

FIG. 4B illustrates a rear perspective view of the frame 310 including the controls section 312, the ice bagger section 314, and the compressor section 316. The compressor section 316 may include a rear opening 332 to accommodate compressor components or to simplify installation of the compressor in the frame 310.

Figure 5:
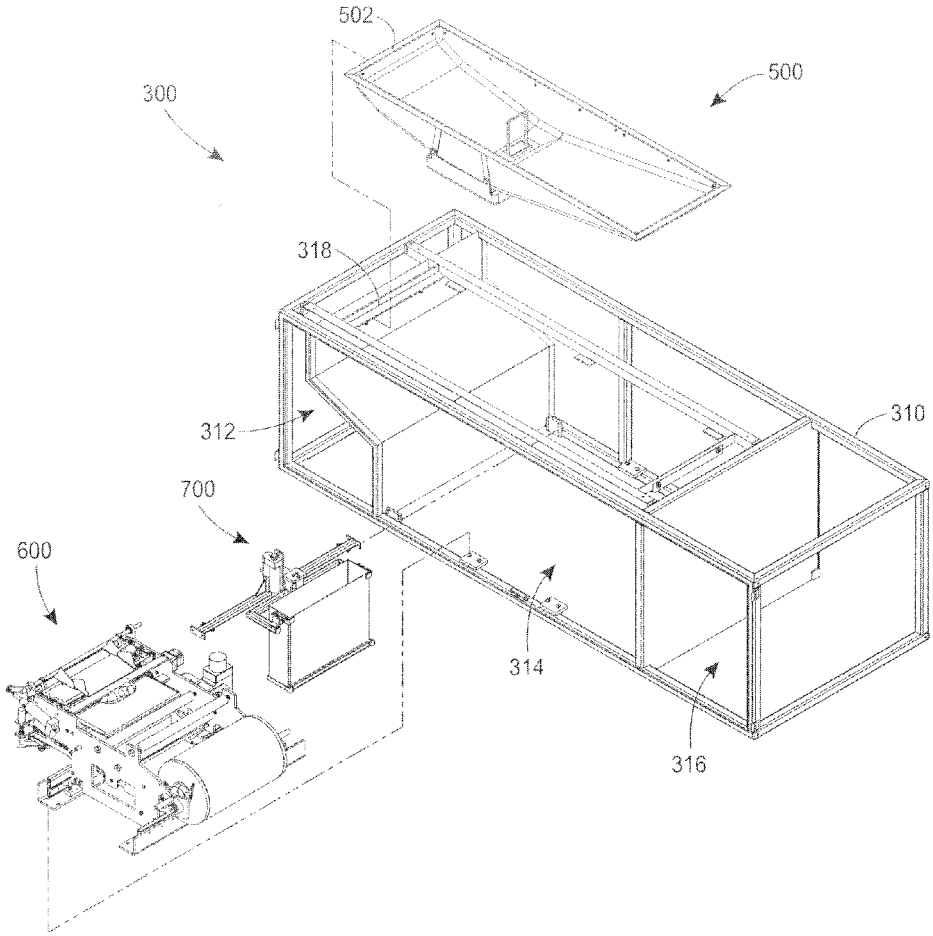
FIG. 5 is an exploded isometric vie of the ice bagging unit of FIG. 2.

FIG. 5 illustrates an exploded perspective view of the frame 310, the hopper 500, the ice bagger 600, and a basket and release assembly 700. The hopper 500 and ice bagger 600 are mounted in the ice bagger compartment 314, while the basket and release assembly 700 is mounted to a bottom of the ice bagger compartment 314. The basket and release assembly 700 may be mounted on a removable means, such as slidable rails or other similar device, like the ice bagger 600 and the hopper 500 as discussed above. The hopper 500 includes an upper lip 502 the fits under the sub-frame 318. The hopper 500 may be secured to the sub-frame 318 by any known method, such as fasteners, welding, adhesive, etc. The basket and release assembly 700 may be attached to the sub-frame 318 with a removable means, such as sliding rails or other equivalent device. The basket and release assembly 700 is positioned to receive a bag from the ice bagger 600 and to support and stabilize the bag as the bag fills with ice. The basket and release assembly 700 also includes a weighing device (not shown), such as a load cell, and a transmitter that sends a signal to the controller when a target weight is reached for ice in the bag.

Figure 6A:
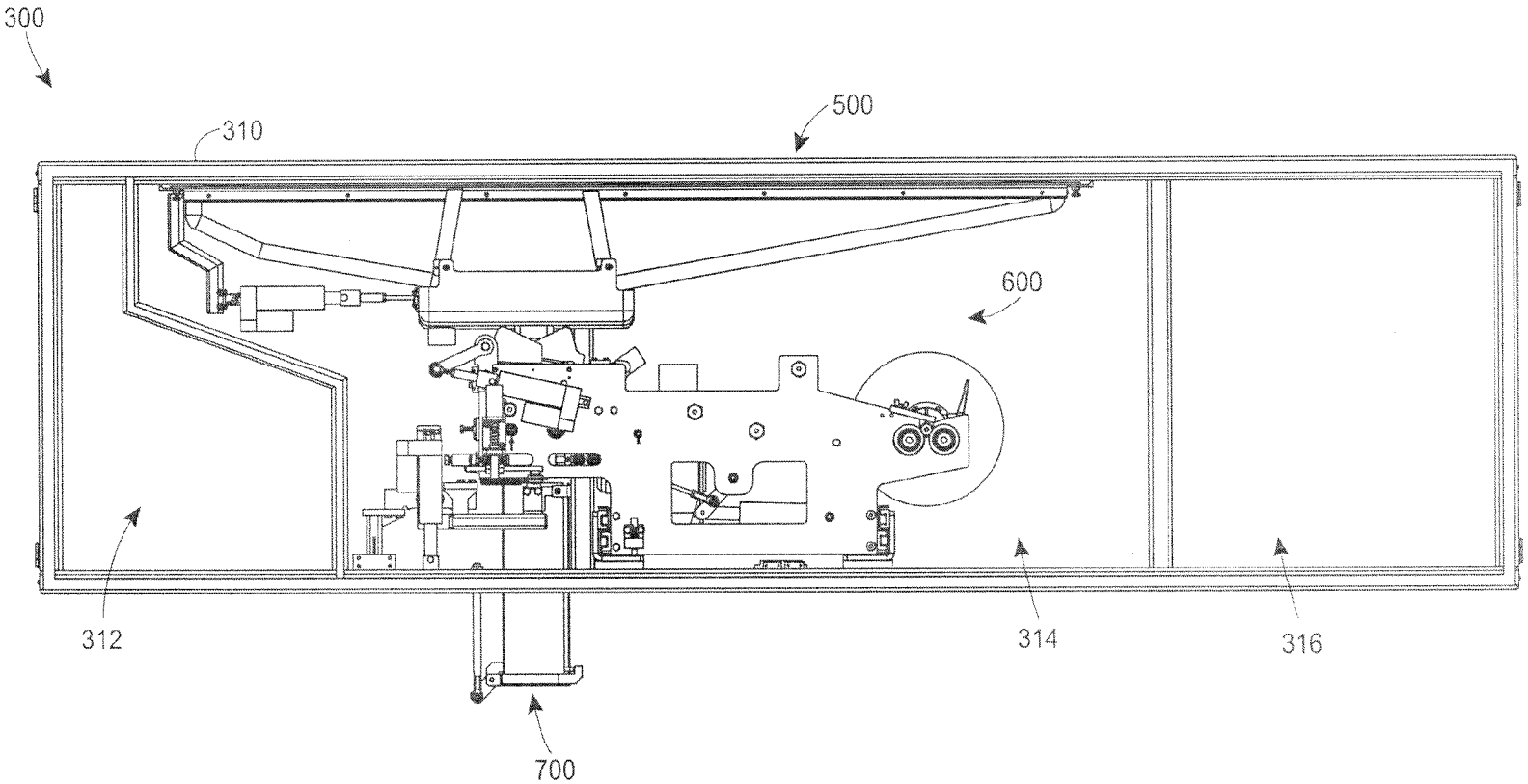
FIGS. 6A-6C are side elevational, end, and top plan views, respectively, of the ice bagging unit of FIG. 2.
Figure 6B:
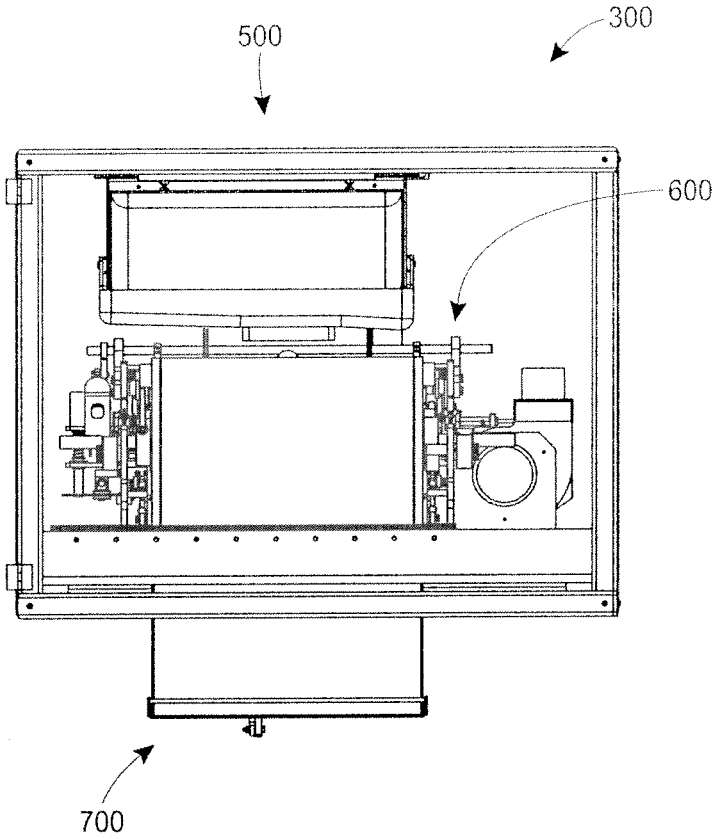
Figure 6C:
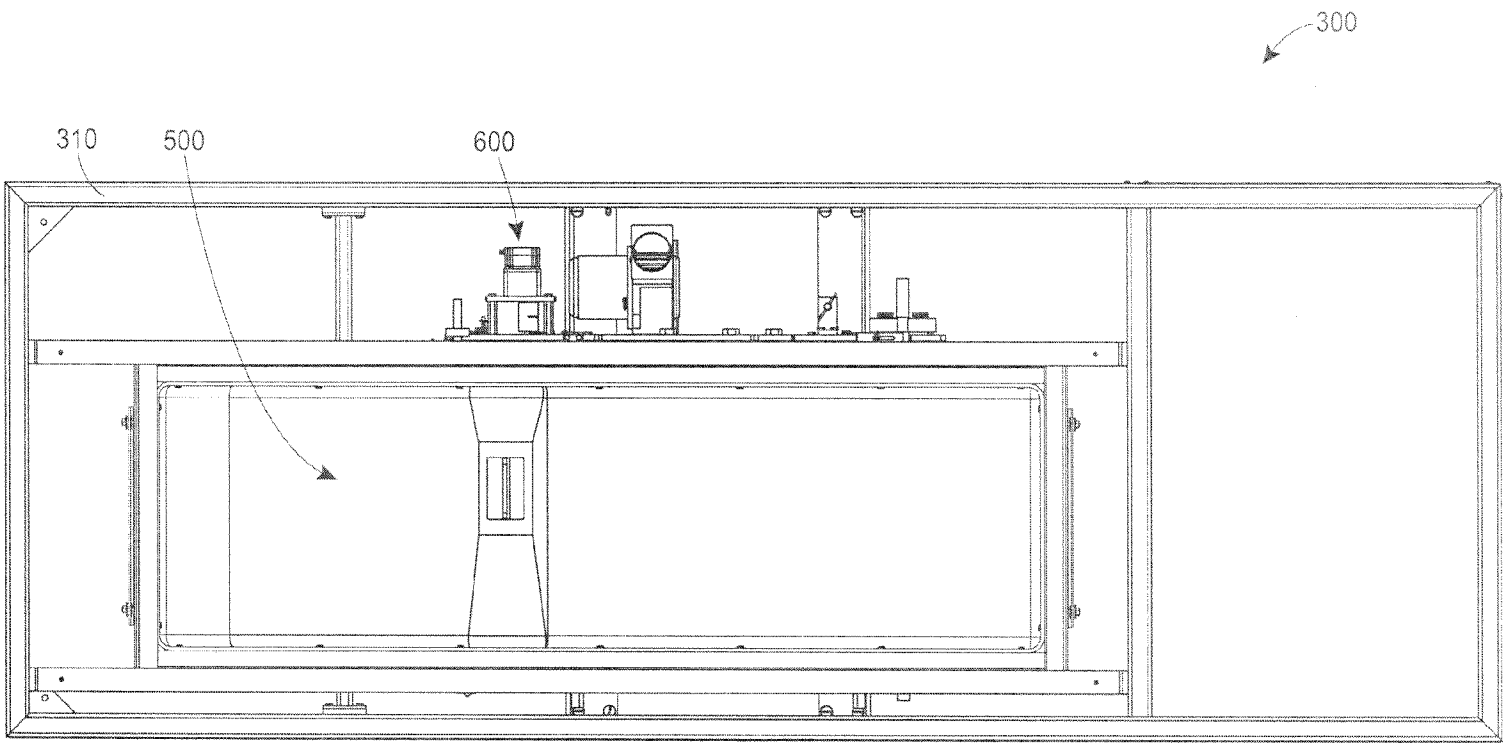
Figure 7A:
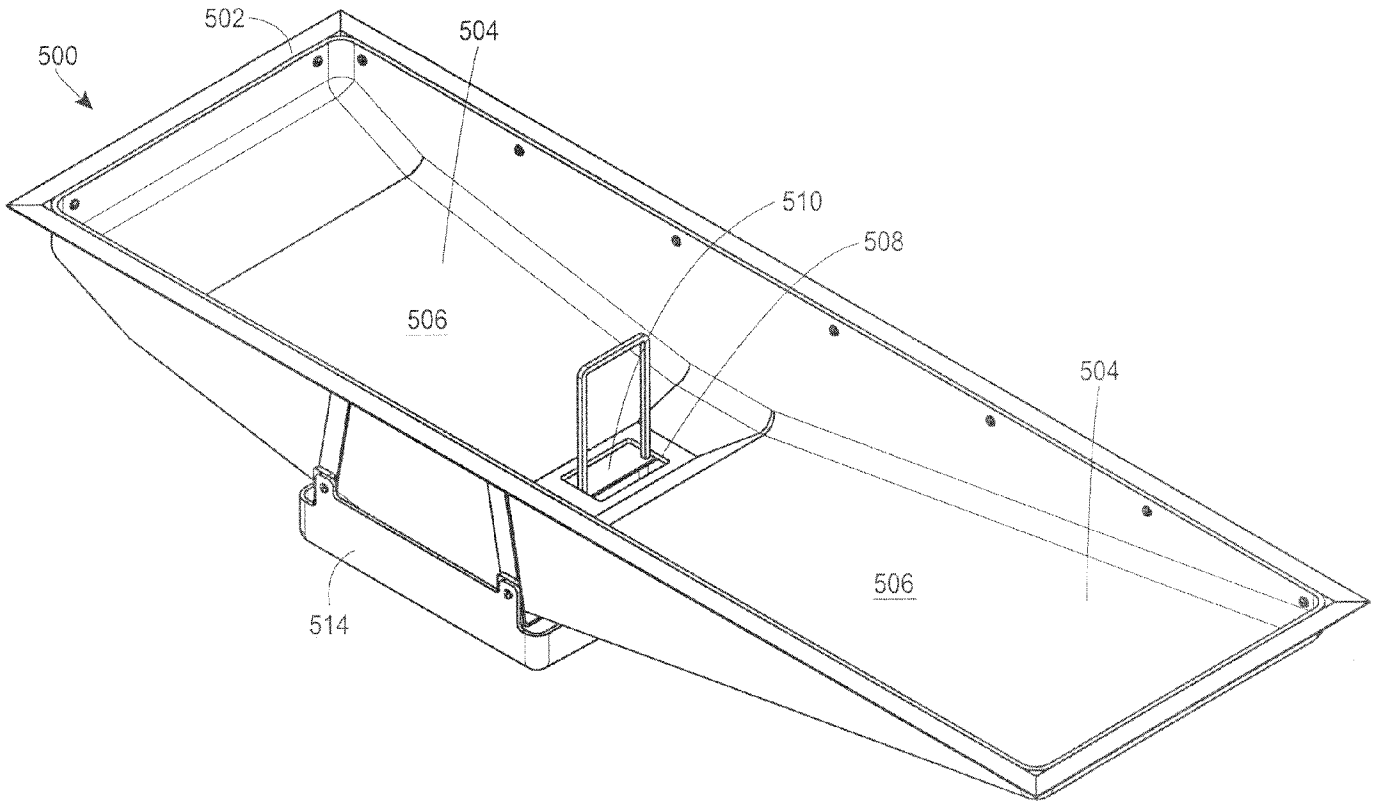
FIGS. 7A-7C are perspective, side elevational, and top plan views, respectively, of a hopper of the ice bagging unit of FIG. 2, with an ice door in a closed position.
Figure 7B:
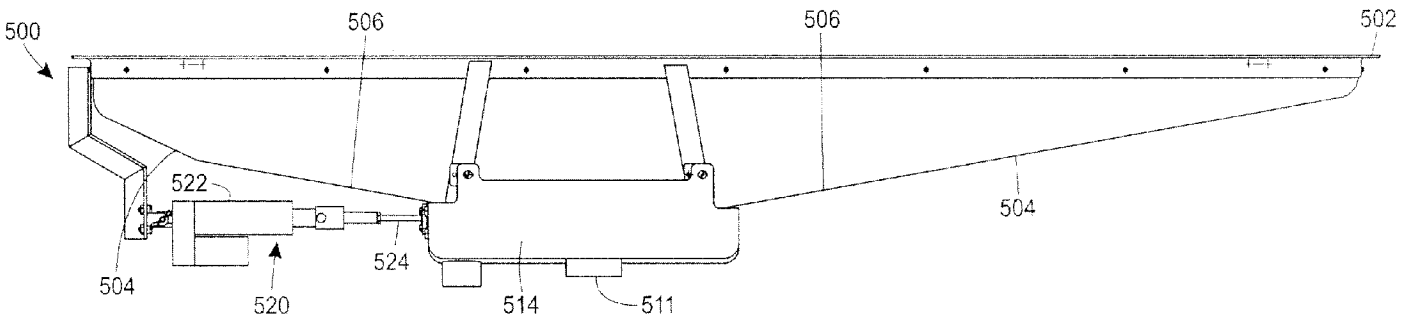
Figure 7C:
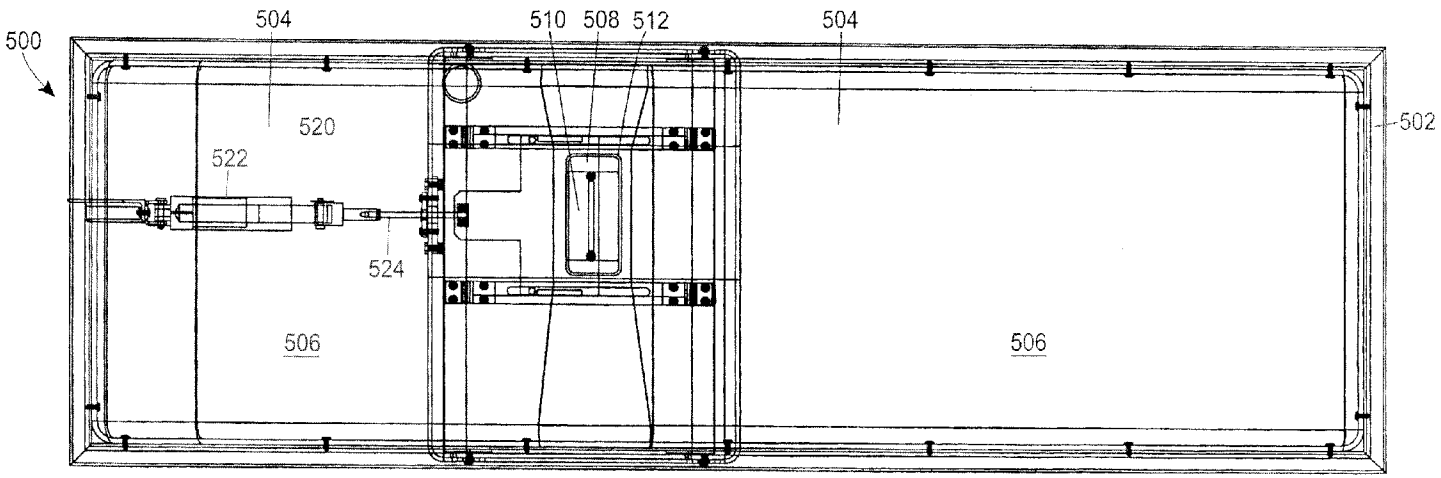
Figure 7E:
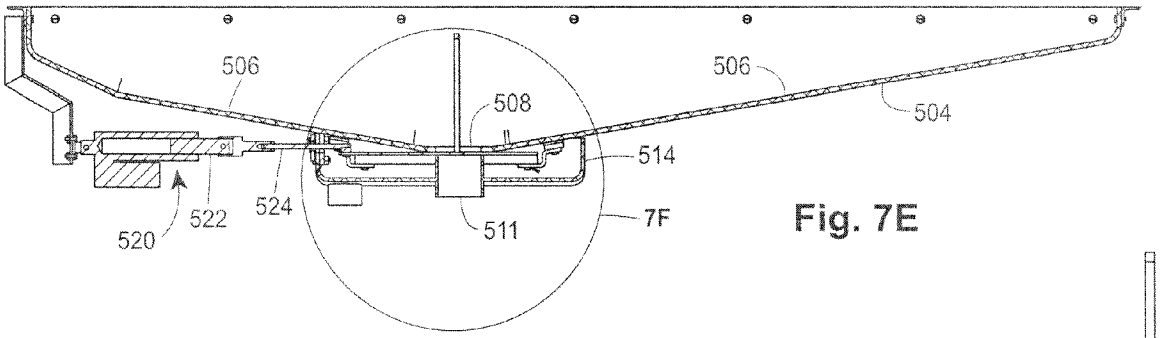
FIGS. 7D and 7E are cross-sectional views of the hopper taken along lines 7D-7D and 7E-7E of FIGS. 7C and 7B, respectively.
Figure 7F:
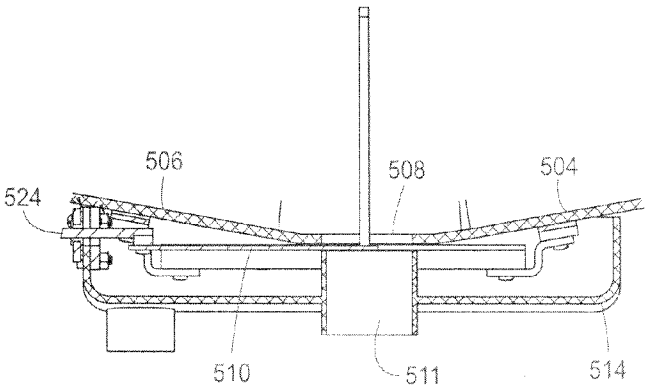
FIG. 7F is a close up view of detail circle 7F in FIG. 7E.
Figure 7D:
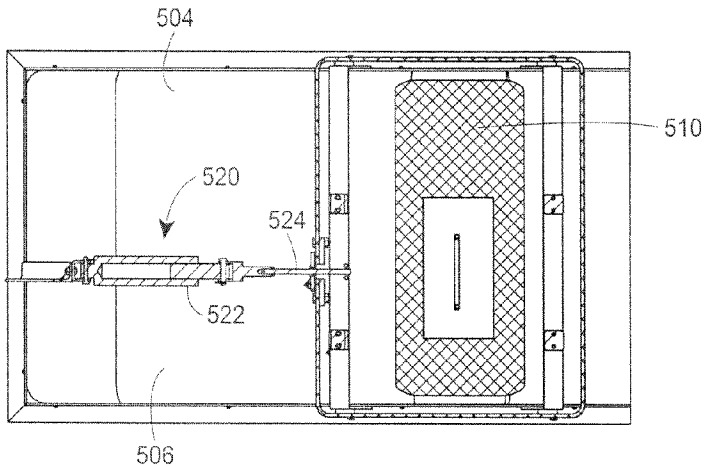
Figure 8A:
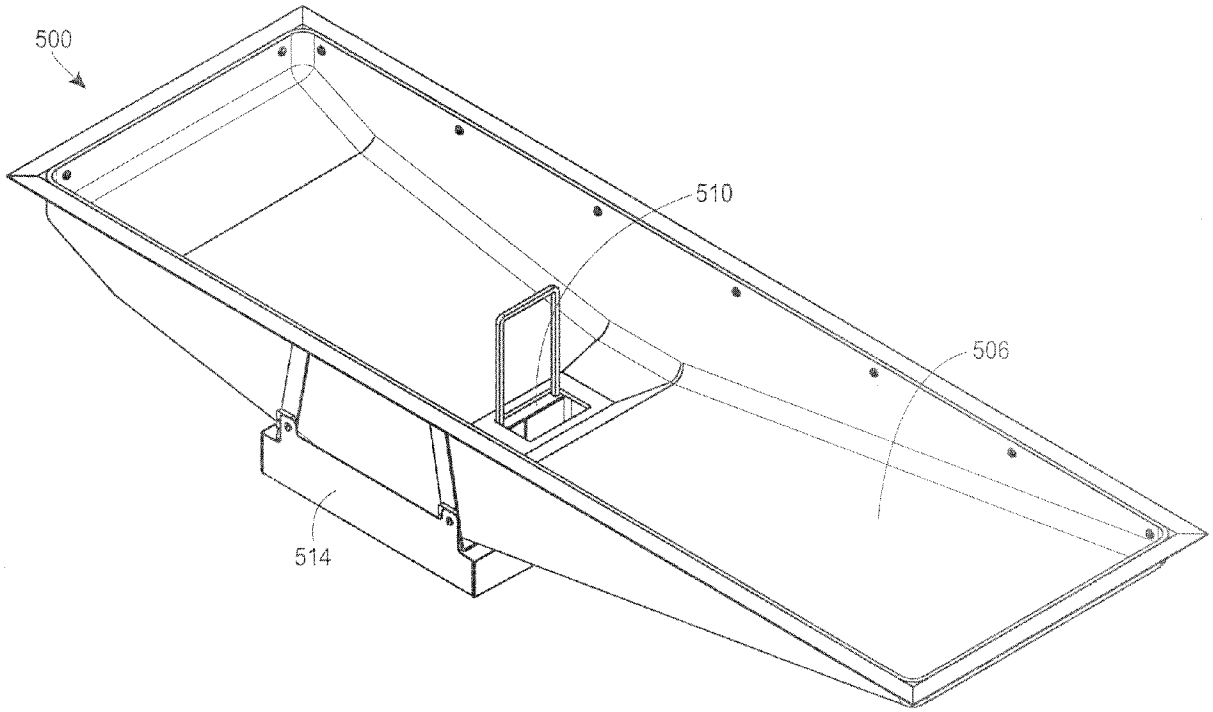
FIGS. 8A-8C are perspective, side elevational, and top plan views, respectively, of the hopper of FIG. 2, with the ice door in a partially open position.
Figure 8B:
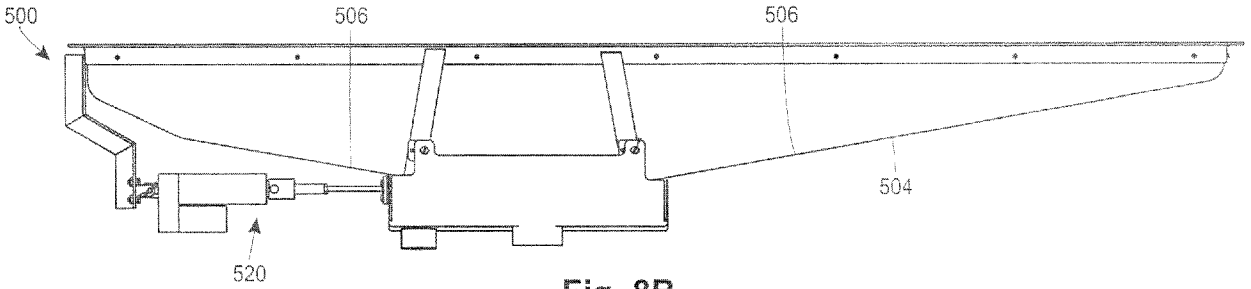
Figure 8C:
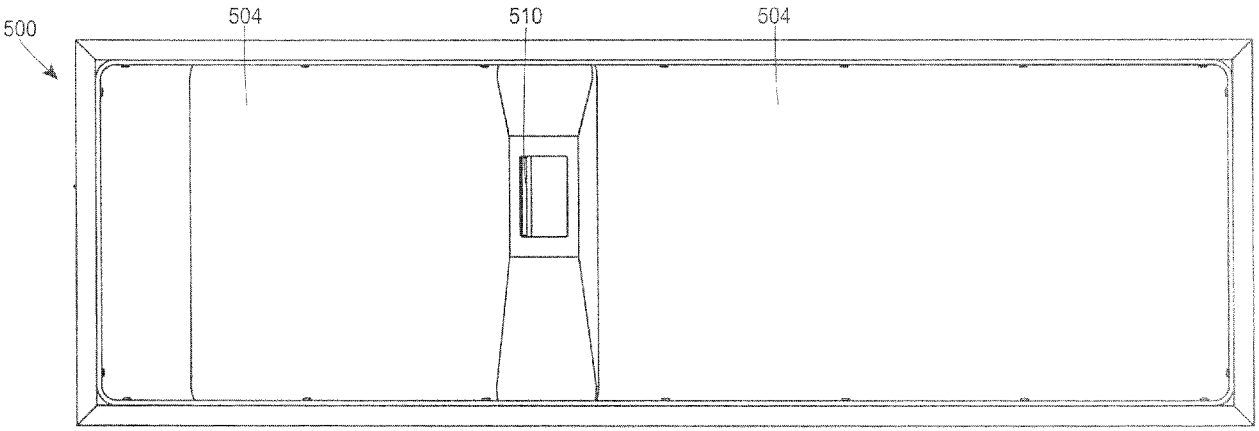
Figure 8E:
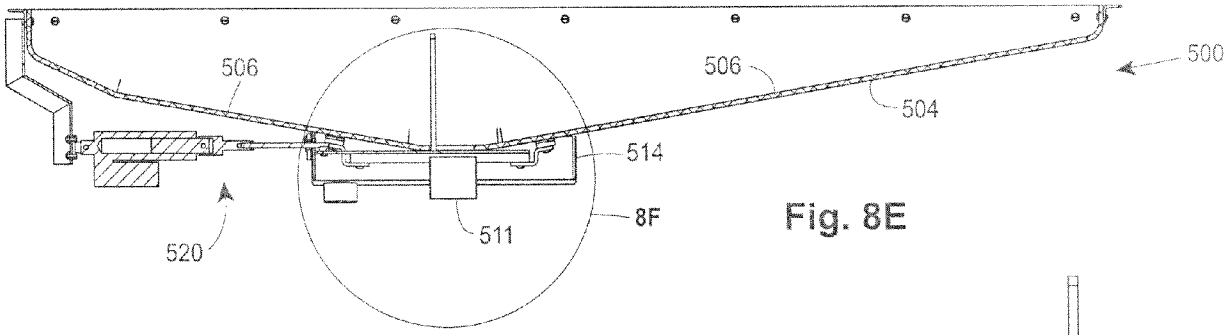
FIGS. 8D and 8E are cross-sectional views of the hopper taken along lines 8D-8D and 8E-8E of FIGS. 8C and 8B, respectively.
Figure 8F:
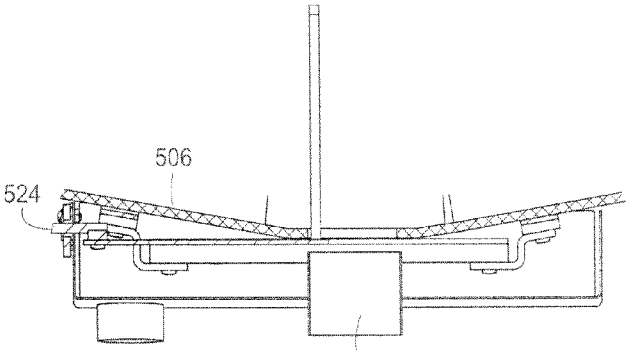
FIG. 8F is a close up view of detail circle 8F in FIG. 8E.
Figure 8D:
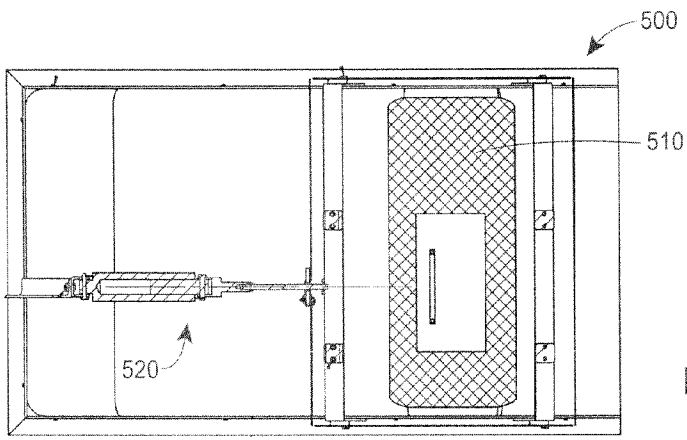

FIGS. 6A-6C illustrate various views of the ice bagging unit 300 with the hopper 500, ice bagger 600, and basket and release assembly 700 installed in the ice bagger section 314.

FIGS. 7A-7F illustrate various views of the hopper 500 with an ice door 510 in a substantially closed position. The hopper 500 includes an ice slide 504 surrounded by the lip 502. The ice slide 504 includes slide surfaces 506 that angle downwardly towards an ice exit 508. The ice exit 508 is an opening in a bottom of the hopper 500. The hopper 500 may include one or more sensors (not shown) to sense levels of ice within the hopper 500. For example, the hopper may include a high level sensor and a low level sensor. When the high level sensor is activated, a supply of ice to the hopper 500 may be shut off. Alternatively, when the low level sensor is activated, a supply of ice to the hopper 500 may be started to replenish ice in the hopper 500. As gravity draws ice downwardly along the slider surfaces 506, the ice eventually ends up at the ice exit 508. A vibrating motor (not shown) may be attached to the hopper 500 to break up ice bridges that may form in the hopper 500 and to reduce friction between the ice and the slider surfaces 506. An exit door 510 selectively opens and closes the ice exit 508 to admit ice from the slide surfaces 506 into the ice exit 508. After passing through the ice exit 508, ice enters an ice chute 511, which funnels the ice into the ice bagger 600. A small gap 512 may partially or completely surround the ice exit 508 to funnel melted ice water into a water tray 514. By collecting melted ice water separately in the water tray 514, the ice in the ice chute 511 will not freeze together into a block when placed in the ice storage unit 400 after bagging. Thus, a customer is provided with individual ice cubes, as opposed to a frozen block of ice cubes, which was often the case in prior art ice bagging machines. Alternatively, the hopper 500 may be formed with two layer construction, a perforated inner layer to allow liquid water to pass, and a solid outer layer to collect the liquid water.

The ice door 510 is mechanically connected to an actuator assembly 520. The actuator assembly 520 comprises an actuator 522 and a linking pin 524. The actuator 522 may be electrically, pneumatically, or hydraulically actuated. The actuator 522 extends and retracts the linking pin 524 upon commands from the controller. The linking pin 524 is attached to the ice door 510 so that the ice door 510 slides from the open position illustrated in FIGS. 7A-7F to the closed position illustrated in FIGS. 8A-8F when the actuator 522 moves the linking pin 524. In other embodiments, the ice door 510 may be moved by direct gearing with an electric motor, or other door moving means known in the art.

FIGS. 8A-8F illustrate various views of the hopper 500 with an ice door 510 in a substantially open position.

The disclosed hopper 500 advantageously receives ice from more than one cuber or freezer, as discussed above, and delivers the ice more efficiently and with reduced ice backup, as compared with prior art hoppers to the ice bagger 600.

Figure 9:
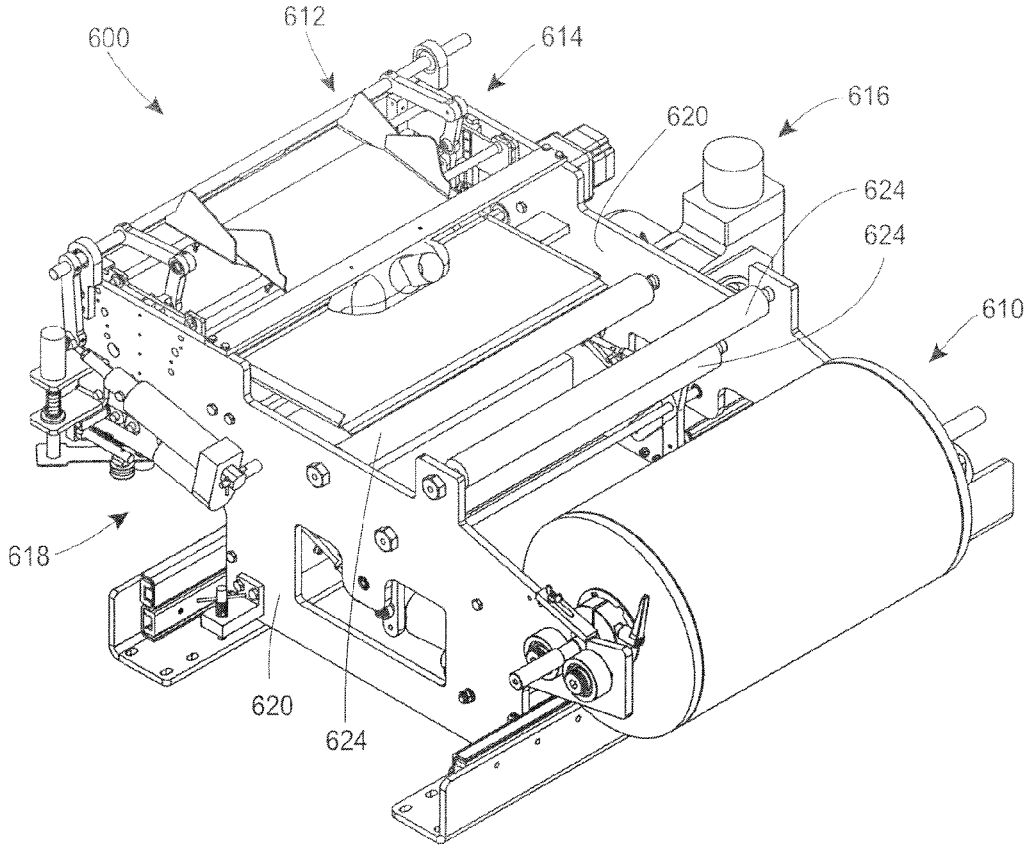
FIG. 9 is an isometric view of ice bagger of the ice bagging unit of FIG. 2.

FIG. 9 illustrates a perspective view of the ice bagger 600. The ice bagger 600 includes a bag roll assembly 610, a finger assembly 612, a pinch roller assembly 614, a blower assembly 616 and a sealing jaw assembly 618 all mounted on a bagger frame 618. Ice bags begin on a bag roll 622 in the bag roll assembly 610 and travel through a plurality of guide rollers 624 to the pinch roller assembly 614, where the bag is opened. Once the bag is opened, the finger assembly 612 directs ice from the hopper 500 (not shown in FIG. 9) into the ice bag. Once the ice bag is filled with an amount of ice, the pinch roller assembly 614 closes the ice bag and the sealing jaw assembly 618 seals the ice bag closed.

Figure 10:
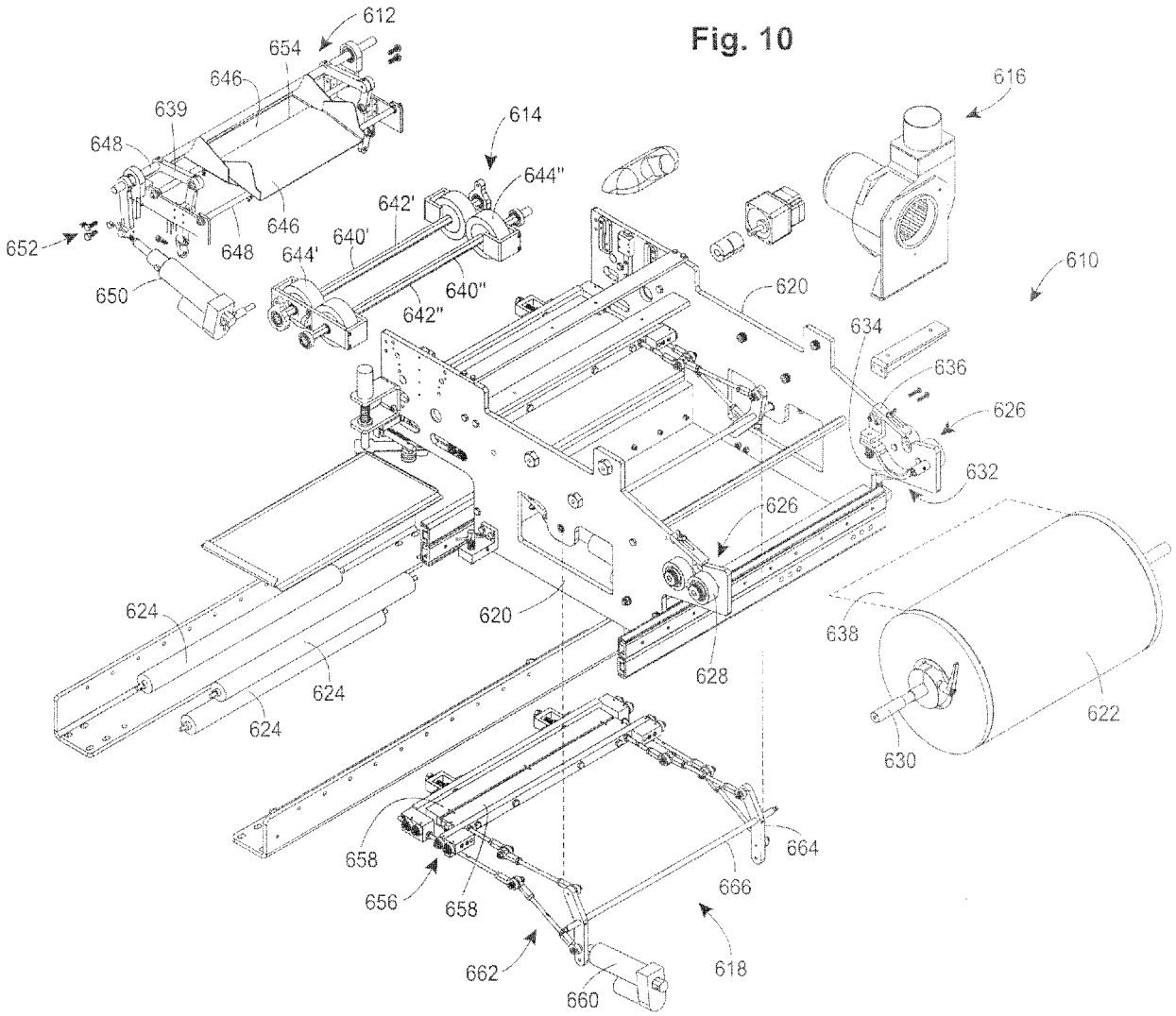
FIG. 10 is an exploded isometric view of the ice bagger of FIG. 9.

Turning now to FIG. 10, the bag roller assembly 610 includes the bag roll 622 and a pair of bag roll mounting locations 626 on the frame 620. One bag roll mounting location 616 includes a pair of roller bearings 628. The roller bearings 628 support the bag roll 622 during rotation and reduce wear on a bag roll axle 630. Additionally, the roller bearings 628, the axle, and thus the sheet of ice bags 638, rotate uniformly. The other bearing mounting location 616 includes a roller brake assembly 632. The roller brake assembly 632 includes a spring mounted brake bar 634 and a mounting bracket 636. The brake bar 634 frictionally engages the roller axle 630 to maintain a proper amount of tension on a sheet of ice bags 638 that are pulled off of the bag roll 622 as the sheet of ice bags 638 travels through the ice bagger 600. Additionally, the break bar 634 prevents the roller axle 630 from rotating in a reverse direction, which would unravel the sheet of ice bags 638 from the ice bagger 600. The brake bar 634 is concavely curved to mirror an outer surface of the roller axle 630. As a result, the brake bar 634 increases contact area with the roller axle 630 producing more friction and greater control of the tension of the sheet of ice bags 638.

After the sheet of ice bags 638 leaves the bag roll 622, the sheet of ice bags 638 passes over or under a set of guide rollers 624 and into the pinch roller assembly 614. The pinch roller assembly 614 includes two pinch rollers 640, each pinch roller including a pinch roller axle 642 and a pair of pinch roller wheels 644, one disposed at each end of the pinch roller axle 642. The sheet of ice bags 638 passes between the first pinch roller 640' and the second pinch roller 640". An optical sensor (not shown in FIG. 10) may determine when to stop advancement of the sheet of ice bags 638 by detecting an optical mark on the sheet of ice bags 638 such that an opening in one bag in the sheet of ice bags 638 is located just prior to the pinch roller wheels 644', 644". The pinch roller wheels 644', 644" move axially inward, towards one another, while pinching the sheet of ice bags 638 so that the opening in the sheet of ice bags 638 is forced open. After the pinch roller wheels 644', 644" move axially inward to open the opening in the sheet of ice bags 638, ice is delivered into the open bag with the finger assembly 612. The blower assembly 616 may blow air into the bag opening to further facilitate opening the bag.

The finger assembly 612 may be operatively connected to the pinch roller assembly 614 by a mechanical coupling or linkage 639 so that single actuator 650 can operate both the finger assembly 612 and the pinch roller assembly 614. In alternative embodiments, the finger assembly 612 and the pinch roller assembly 614 may be operated by separate actuators and sequencing of the finger assembly 612 and the pinch roller assembly 614 may be controlled by the controller.

Figure 11A:
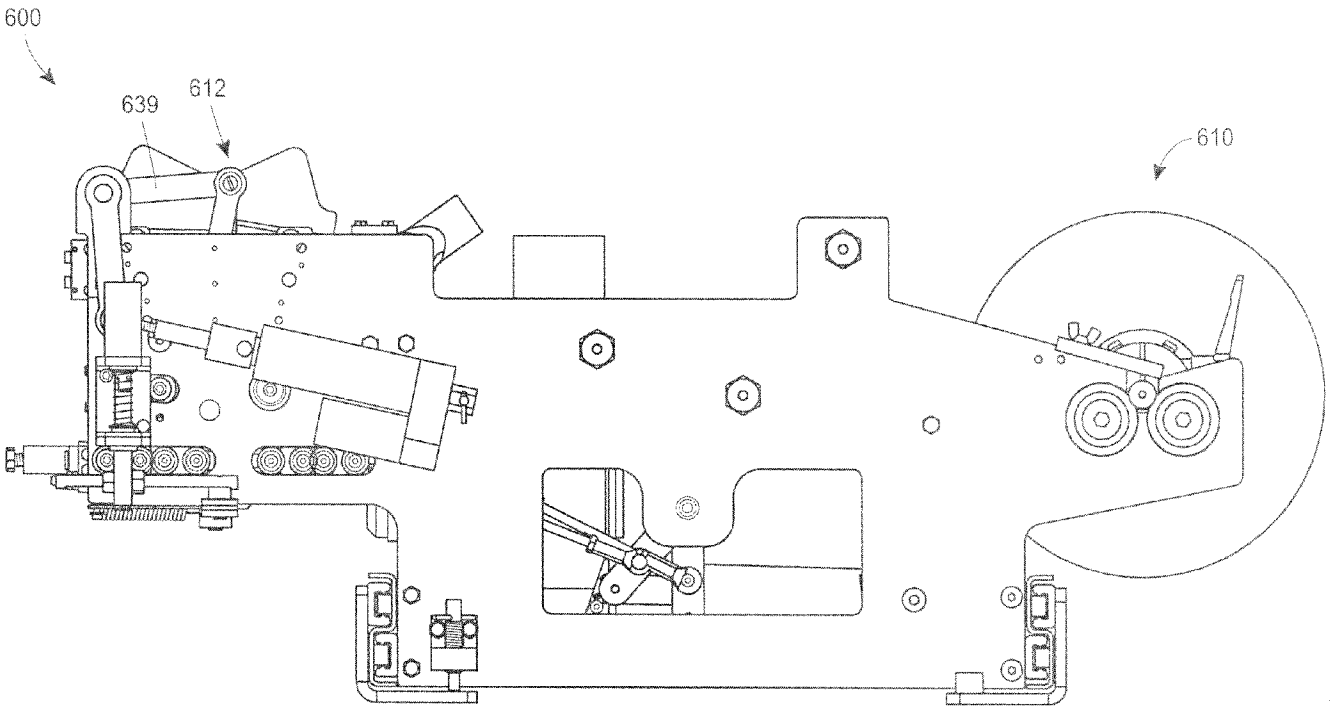
FIGS. 11A-11C are a front side elevational view, an end view, and a top plan view, respectively of the ice bagger of FIG. 9.
Figure 11B:
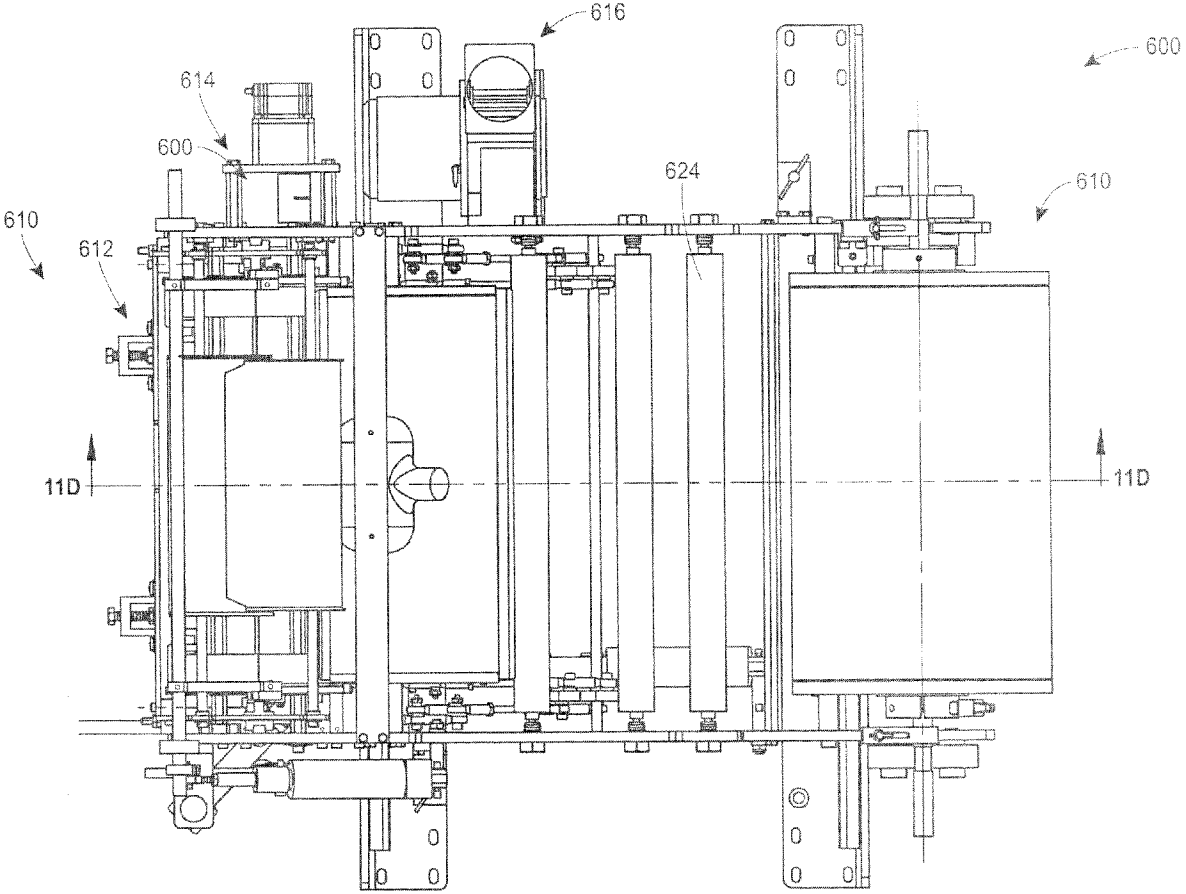
Figure 11C:
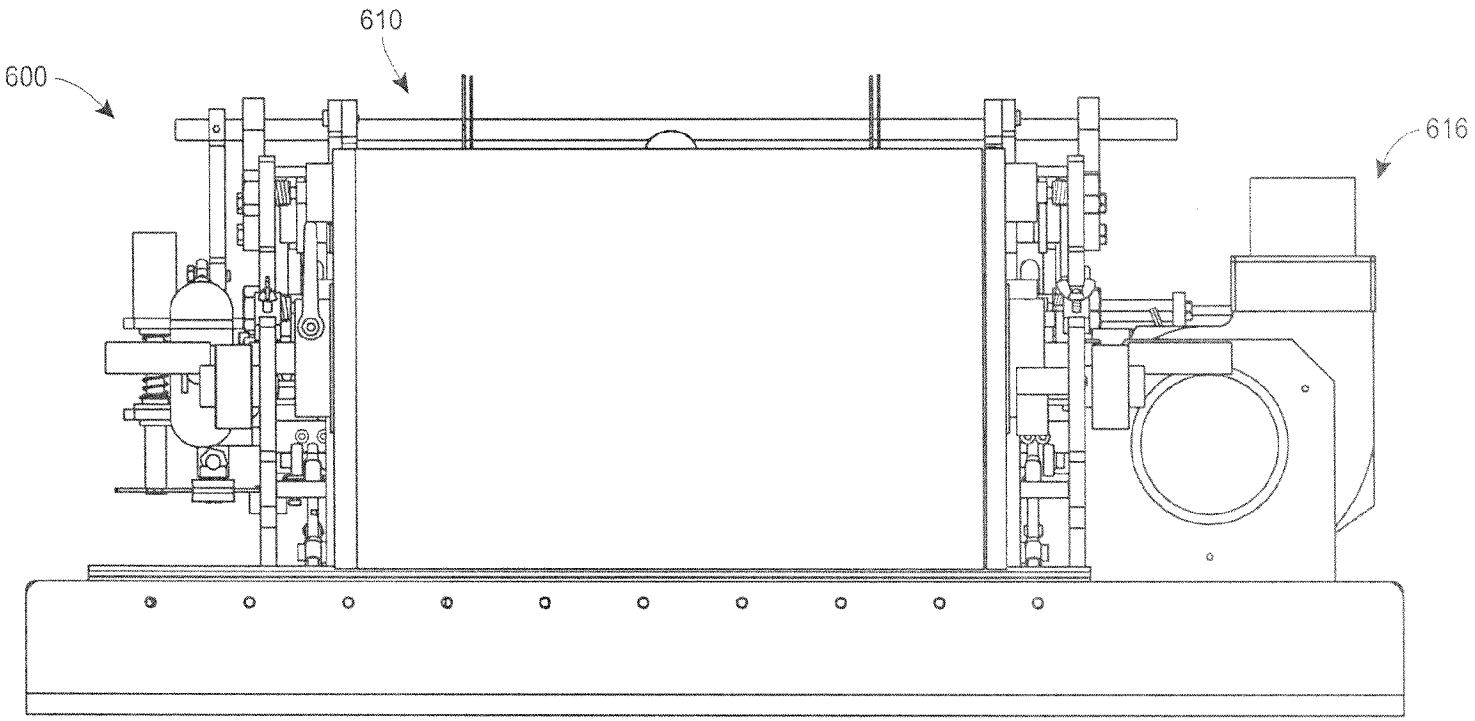
Figure 11D:
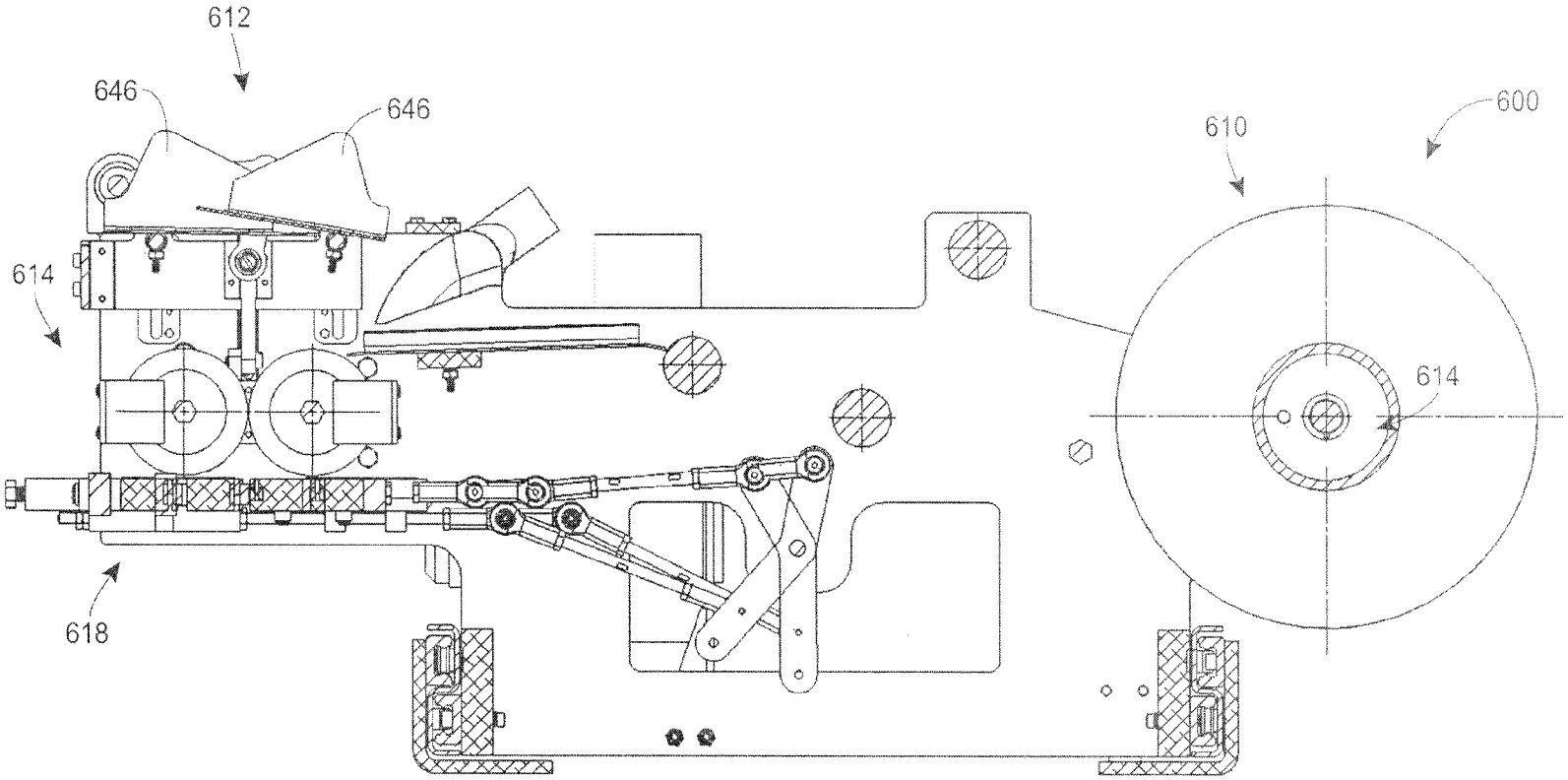
FIG. 11D is a side cross-sectional view of the ice bagger taken along line 11D-11D of FIG. 11B.
Figure 11E:
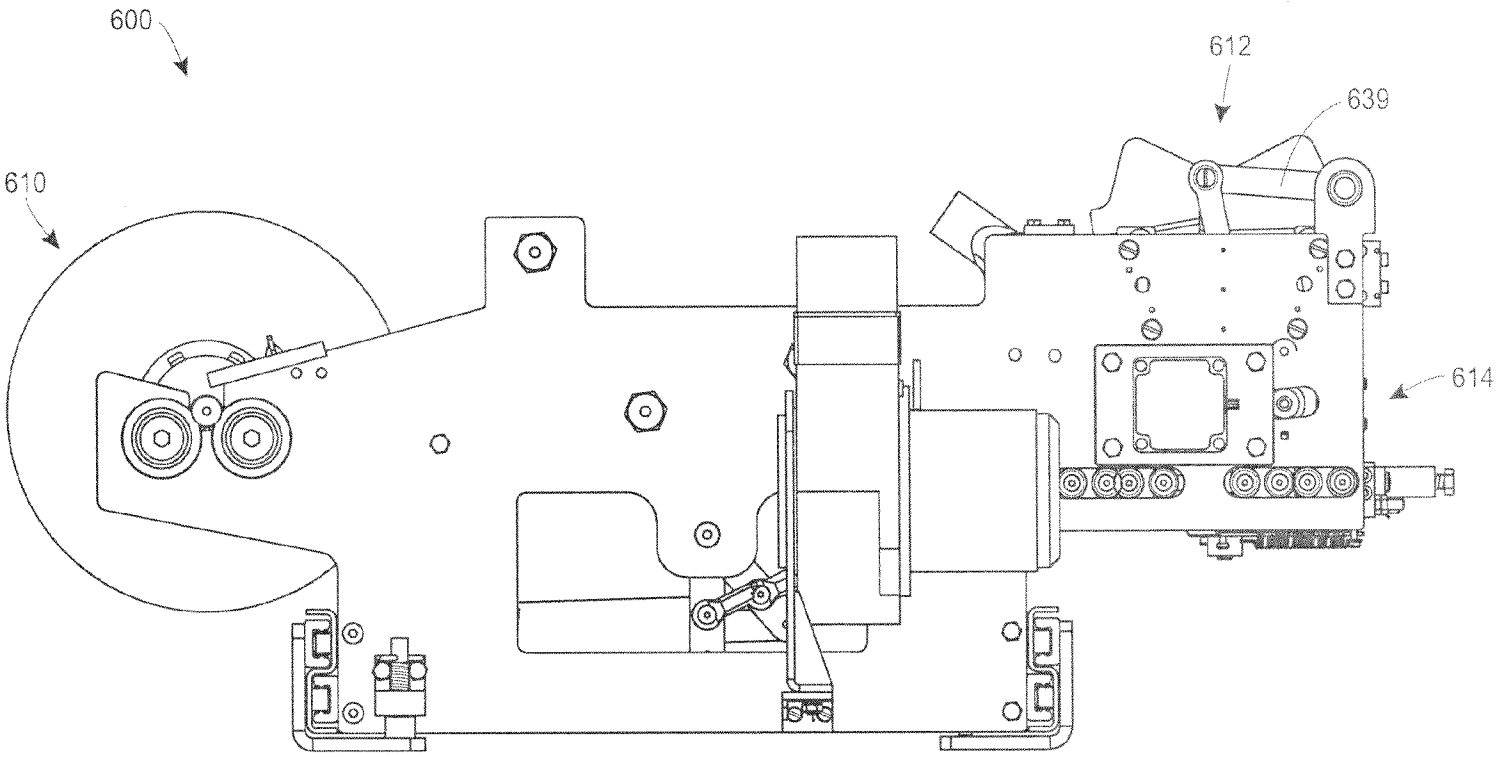
FIG. 11E is a rear side elevational view of the ice bagger of FIG. 9.

The finger assembly 612 includes a pair of finger plates 646 that are each pivotably mounted to a finger rod 648. The actuator 650 and linking mechanism 652 operate to rotate the finger rods 648 to move the finger plates 646 into extended or retracted positions. In the extended position, distal ends 654 of the finger plates extend into the open bag, thereby directing ice into the bag. Moreover, the finger plates 646 prevent moisture from contacting the bag plies in the vicinity of the sealing location. Thus, better bag sealing is achieved by the sealing jaw assembly 618. When the bag has reached a determined level of ice, the actuator 650 causes the finger rods 648 to rotate, which causes the finger plates 646 to move to the retracted position, in which the distal ends 654 of the finger plates 646 are removed from the bag opening. In this embodiment, the finger plates 646 are mounted on separate finger rods 648 and the finger plates 646 rotate in opposite directions. More specifically, one finger plate 646 rotates clockwise and the other finger plate 646 rotates counterclockwise, as viewed in FIG. 11D.

Once the finger plates 646 are removed from the bag opening, the sealing jaw assembly 618 seals the bag opening. The sealing jaw assembly includes a sealing clamp 656 having two movable sealing jaws 658. The sealing jaws 658 are connected to an actuator 660 by a linking assembly 662. The actuator 660 moves a cross-tie 664 located on a linking rod 666. The sealing jaws 658 may seal the bag opening with heat, pressure, ultrasound, or any other sealing process.

FIGS. 11A-11F illustrate various views of the ice bagger 600.

Figure 12A:
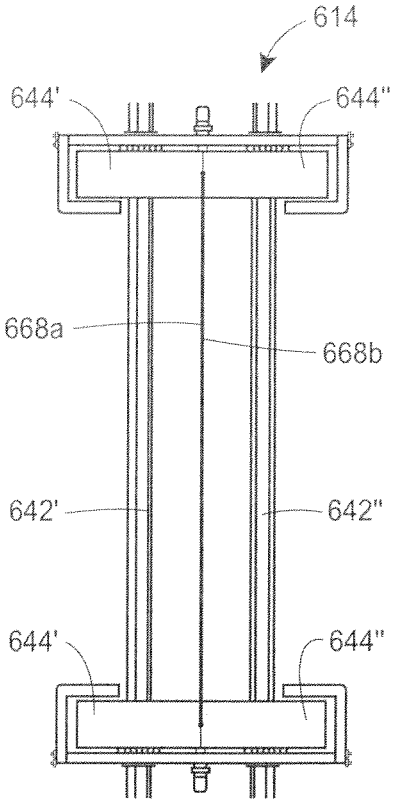
FIGS. 12A and 12 B are top plan views of a pinch roller assembly of the ice bagger of FIG. 9 in bag closed and bag open positions, respectively.
Figure 12B:
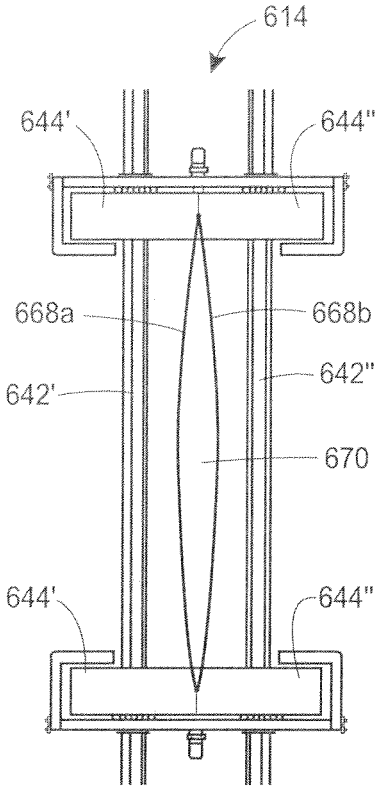
Figure 12C:
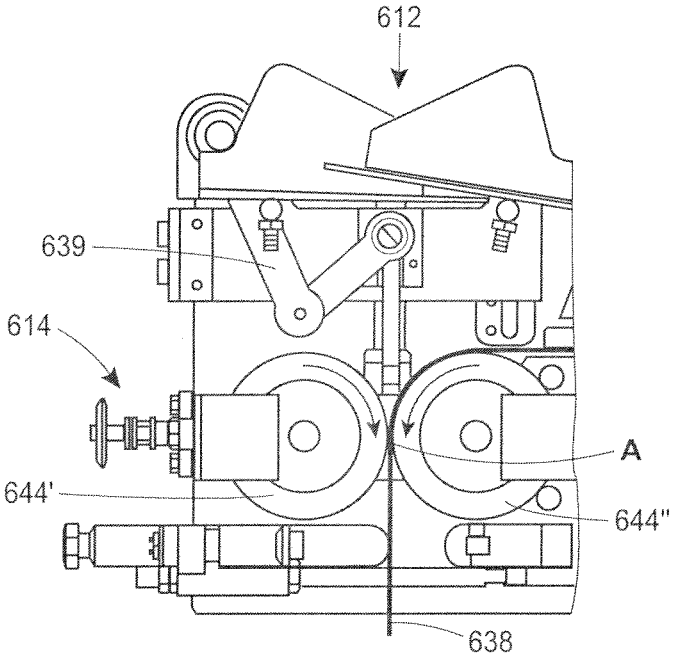

FIGS. 12A-12C illustrate the pinch roller assembly 614, including the pinch roller rods 642' 642" and the pinch roller wheels 644', 644". As illustrated in FIG. 12C, the sheet of ice bags 638 passes over the second pinch roller wheel 644", which changes direction of the sheet of ice bags 638 by approximately 90 degrees, and then between the first pinch roller wheel 644' and the second pinch roller wheel 644". The first and second pinch roller wheels 644', 644", which rotate in opposite directions (i.e., the first pinch roller wheel 644' rotates clockwise and the second pinch roller wheel 644" rotates counterclockwise in FIG. 12 C), pinch the sheet of ice bags 638 and pull the sheet of ice bags 638 through the ice bagger 600. When the sheet of ice bags 638 reaches a point in which an opening of an individual bag in the sheet of ice bags 638 is proximate a point of contact A between the first and second pinch roller wheels 644', 644", the first and second pinch roller wheels 644', 644" stop rotation. The first and second pinch roller wheels 644', 644" move inwardly, as illustrated in FIG. 12B to force opposing plies 668*a*, 668*b* apart to expose an opening 670 of the ice bag. After the ice bag is filled with a predetermined amount of ice, the first and second pinch roller wheels 644', 644" move outward, which brings the opposing plies 668*a*, 668*b* of the ice bag together, closing the opening 670.

Figure 13:
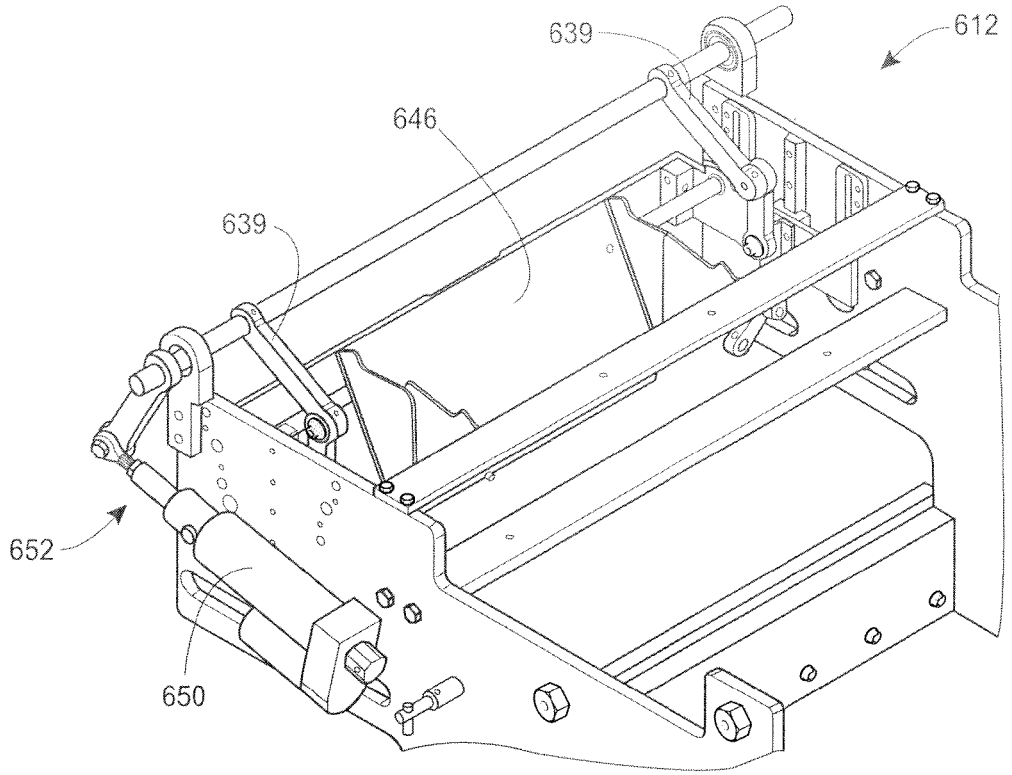
FIG. 13 is a perspective view of a finger assembly of the ice bagger of FIG. 9.
Figure 14A:
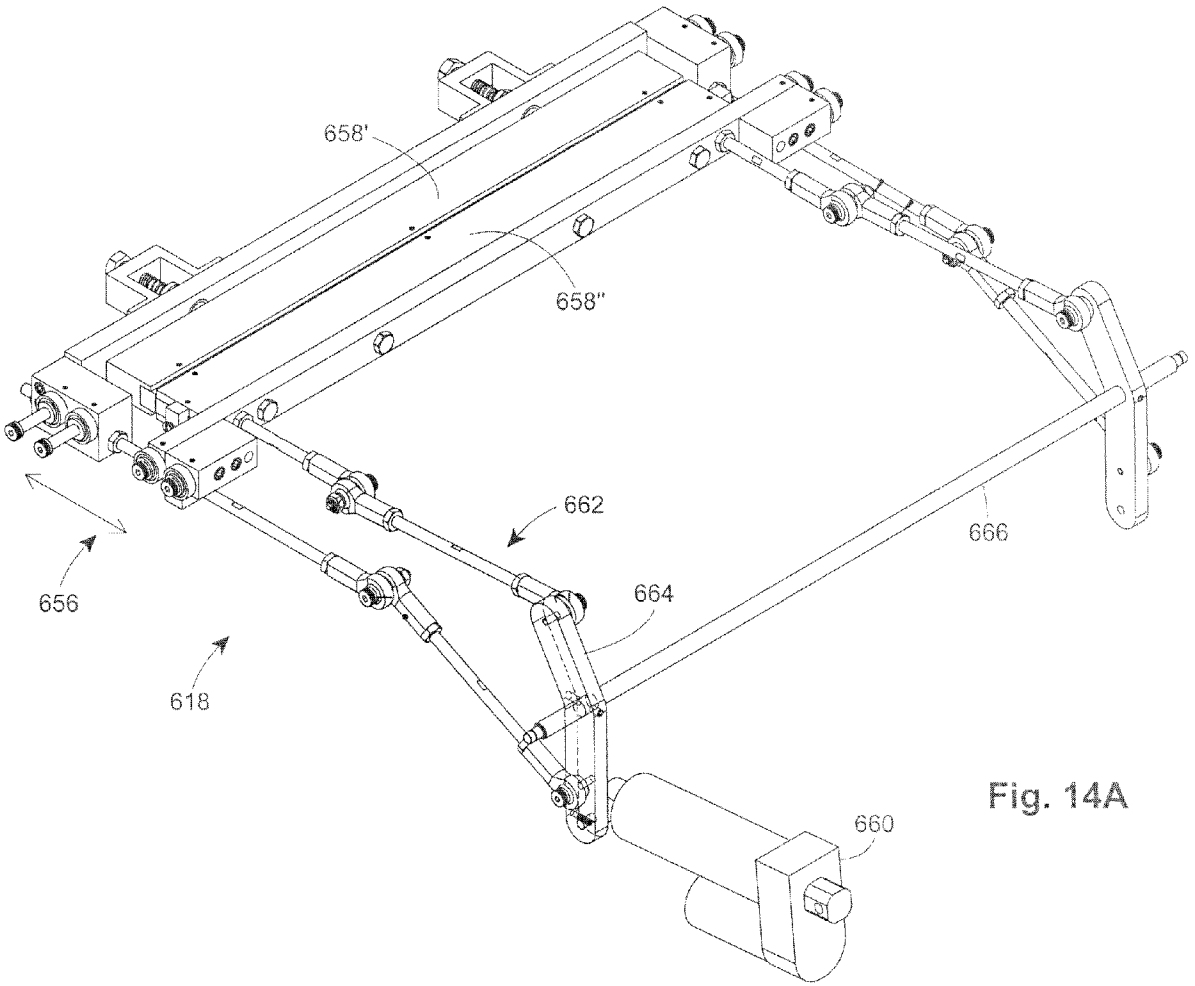
FIGS. 14A and 14B are isometric views of a sealing jaw assembly of the ice bagger of FIG. 9 in closed and open positions, respectively.
Figure 14B:
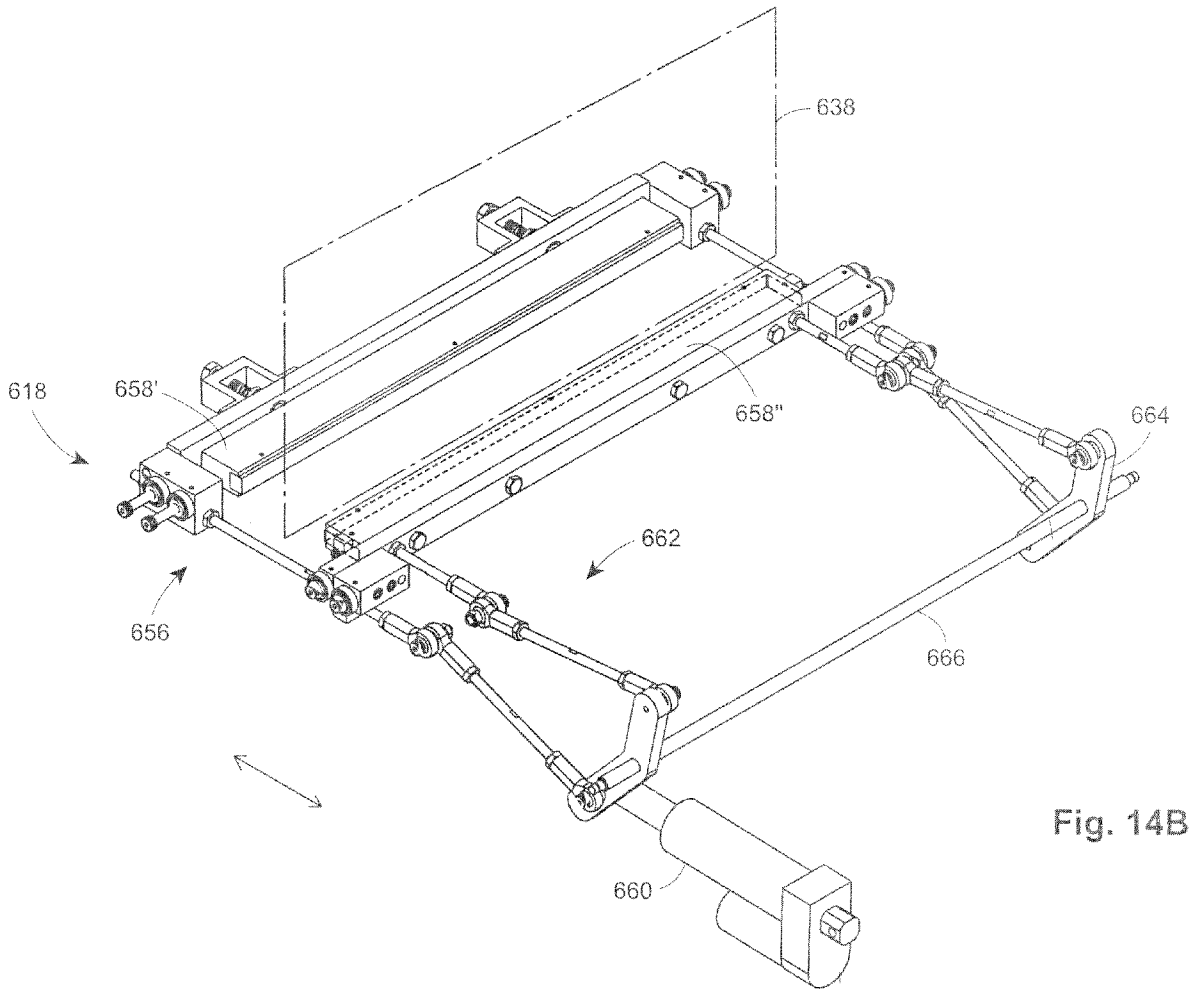
Figure 14E:
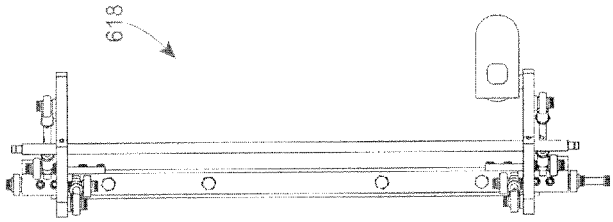
FIGS. 14C-14E are side elevational, top plan, and end views, respectively, of the sealing jaw of FIG. 14B.
Figure 14C:
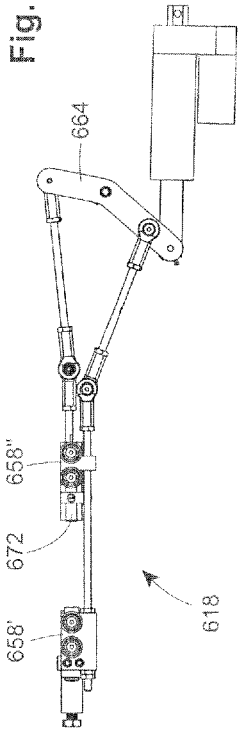
Figure 14D:
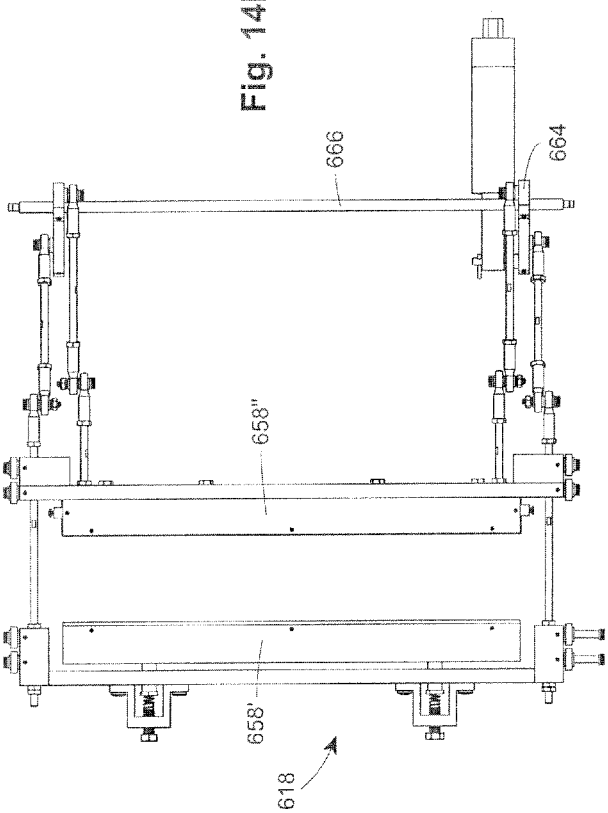
Figure 16B:
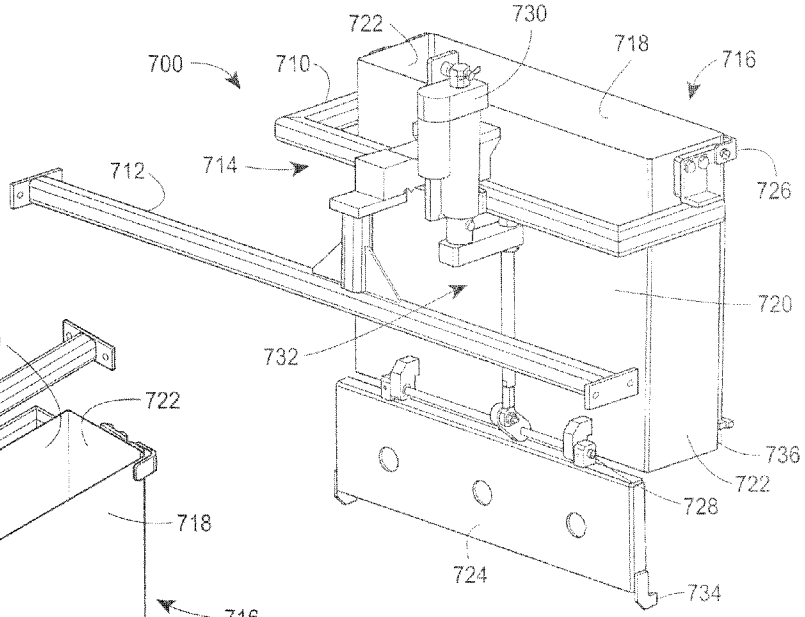
Figure 16A:
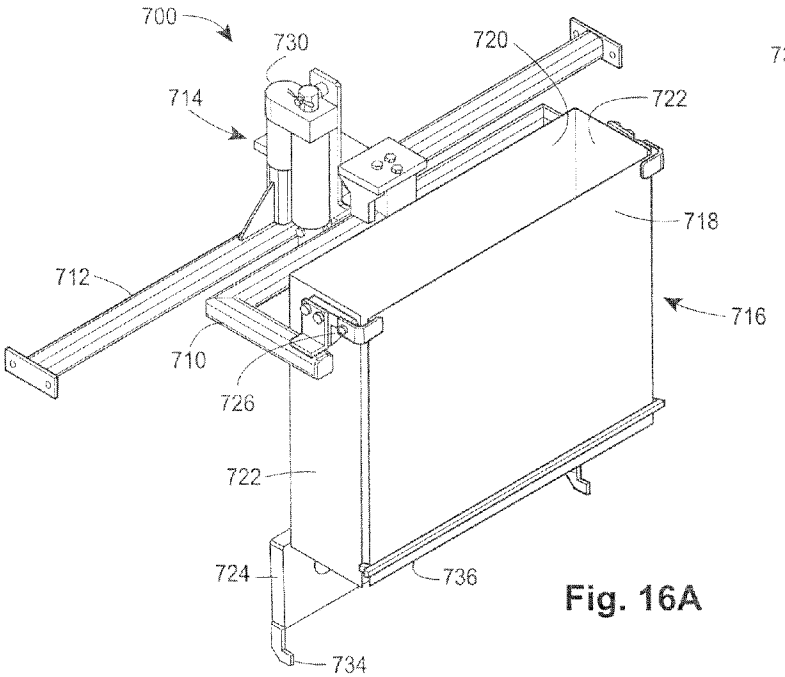
Figure 16D:
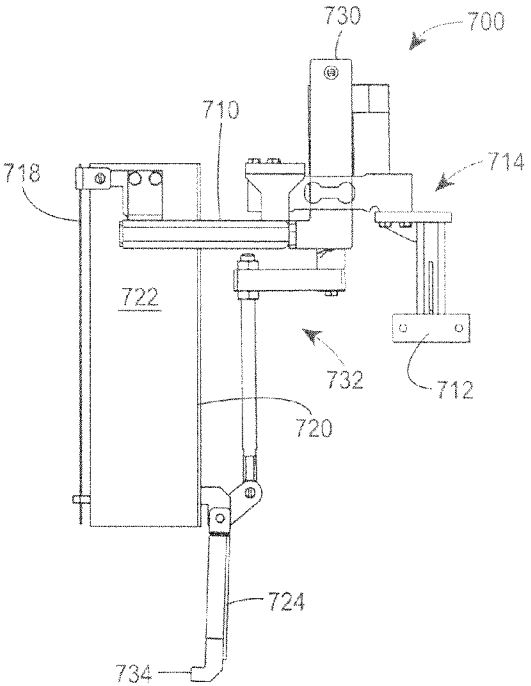
Figure 16C:
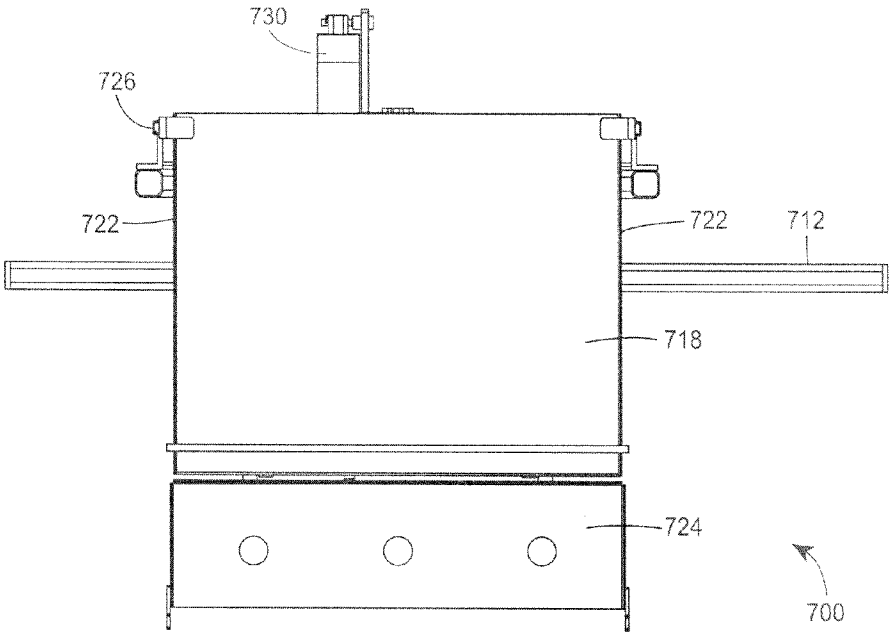
Figure 16E:
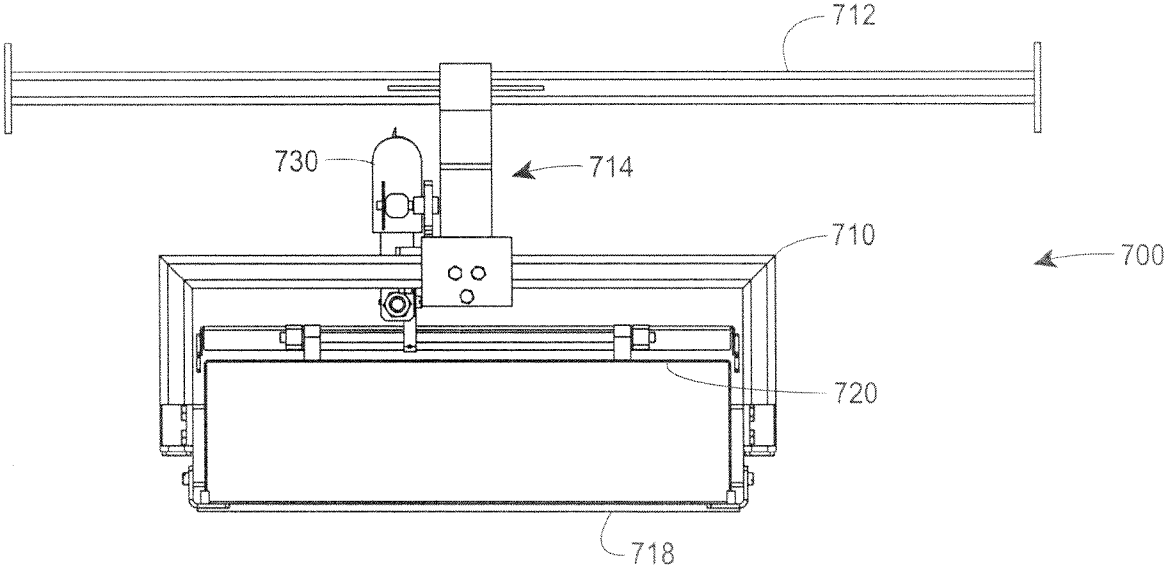

FIG. 13 illustrates the finger assembly 612, which includes a pair of finger plates 646 pivotably mounted on the finger rods 648, the actuator 650 and a linking assembly 652 connecting the actuator 650 to the finger rods 648. The finger plates 646 are illustrated in an extended position in FIG. 13. In the extended position, distal ends 654 (FIG. 10) are inserted into the opening 670 (FIG. 12B) to direct ice from the hopper 500 into the opening 670.

Once the ice bag is filled with a predetermined amount of ice, and the pinch roller wheels 644', 644" have moved outward to close the ice bag opening 670, the sealing jaw assembly 618 of FIGS. 14A-14E seals the ice bag opening 670 to prevent ice from falling out of the ice bag. The sealing jaw assembly 618 includes a sealing clamp 656 having first and second sealing jaws 658', 658". The sealing jaw assembly 618 is illustrated in a closed, sealing position in FIG. 14A and an open position in FIG. 14B. Once the pinch roller wheels 644', 644" position the ice bag with an opening proximate the pinch roller wheels 644', 644" and the bag opening 670 is closed, the actuator 660 actuates across-tie 664 mounted on a linking rod 666. The cross-tie 664, in turn, actuates a linking mechanism 662 that moves the first and second sealing jaws 658', 658" towards, or away from, one another.

Once the ice bag opening 670 is sealed, the actuator moves the cross-tie in an opposite direction, causing the linking mechanism 662 to move the first and second sealing jaws 658', 658" away from one another, so that the sheet of ice bags 638 may pass between the first and second sealing jaws 658', 658". The second sealing jaw 658" in this embodiment, includes a sealing element 672 that produces a sealing force (e.g., heat, ultrasound, pressure, etc.) when the sealing jaws 658', 658" are in the closed position (FIG. 14A) to seal the opening 670 of the ice bag.

FIGS. 15A-15C illustrate the basket and release assembly 700 in closed (FIG. 15A), partially open (FIG. 15B), and open (FIG. 15C) positions. The basket and release assembly 700 includes a support frame 710 that is attached to a mounting bar 712. The mounting bar 712 is, in turn, attached to the ice bagging unit frame 310 (see e.g., FIG. 5). Thus, the basket and release assembly 700 is ultimately supported by the ice bagging unit frame 310. A load cell 714 is disposed between the support frame 710 and the mounting bar 712. In one embodiment, the load cell 714 may by a stress or strain gauge. In other embodiments, the load cell 714 may take the form of virtually any device useful for measuring weight, such as a spring scale, a deflection scale, etc. The load cell 714 measures a weight of ice in a bag, while the bag is supported by the basket and release assembly 700. The load cell 714 sends a signal to the controller indicating the measured weight. When a predetermined or set weight is reached, the controller sends a signal to the hopper 500 to close the ice door 510 (FIG. 7A), thereby terminating the flow of ice into the bag.

The basket and release assembly 700 also includes an ice bag retention bin 716. The retention bin 716 supports the ice bag while the ice bag is being filled with ice, thereby reducing stress on the pinch roller assembly 614 and sealing jaw assembly 618. The ice bag retention bin 716 includes a front or first wall 718, a rear or second wall 720, a pair of side walls 722, and a bottom door 724. The rear wall 720 and side walls 722 are fixed to one another and the side walls 722 are attached to the support frame 710. The front wall 718 is pivotably mounted to the side walls 718 with a first hinge 726. In other embodiments, the front wall may be fixed to the side walls and the front wall may flare outward from top to bottom producing a bag retention bin 716 having a larger lower opening than an upper opening. Either the hinged front wall 718, or the flared front wall (not shown), reduces the possibility of the ice bag becoming stuck due to friction within the ice retention bin 716 as the ice bag fills with ice. The bottom door 724 is pivotably mounted to the rear wall 720 with a second hinge 728. The bottom door 724 is connected to an actuator 730 by a linking assembly 732. The actuator 730 moves the linking assembly 732 to open and close the bottom door 724. The bottom door 724 includes a front upturned lip 734. The front upturned lip 734 overlaps a bottom edge 736 of the front wall 718 when the bottom door 724 is in a closed position (FIG. 15A).

An ice bagging sequence begins with the basket and release assembly 700 having the bottom door 724 closed. An ice bag is partially disposed in the retention bin 716 with a top portion of the ice bag (including the ice bag opening) being held by the pinch roller assembly 614 (FIG. 10), which is disposed above the basket and release assembly 700. Gravity pulls a bottom portion of the ice bag into the retention bin 716. As ice begins pouring into the ice bag through the opening 670 (FIG. 12B), the bottom portion of the bag rests on the bottom door 724. Thus, the retention bin 716 supports the weight of the ice bag and ice within the ice bag. Once the controller receives a signal from the load cell 714 indicating that the correct amount of ice is in the ice bag, the controller sends a signal to the actuator 730 to open the bottom door 724 (FIG. 15B). Once the bottom door 724 is opened, the ice bag weight is fully supported by the pinch roller assembly 614. The front wall 718 pivots outward to reduce friction on the retention bin 716 that may prevent a full ice bag from falling out of the retention bin 716. The sealing jaw assembly 618 (FIG. 14A) then seals the ice bag and a bag separation mechanism 750 (FIGS. 17A-17B) activates to separate the ice bag from the sheet of ice bags 638 via, for example, punching through a perforated portion of the sheet of ice bags 638. Once the perforated portion begins to tear, the weight of the ice bag continues tearing the perforated portion until the ice bag detaches from the sheet of ice bags 638. The front wall 718 pivots freely about the first hinge 726 to allow the ice bag to fall out of the retention bin 716 (FIG. 15C).

FIGS. 16A-16E illustrate various views of the basket and release assembly 700 with the bottom door 724 in the open position shown in FIG. 15B.

Figure 17B:
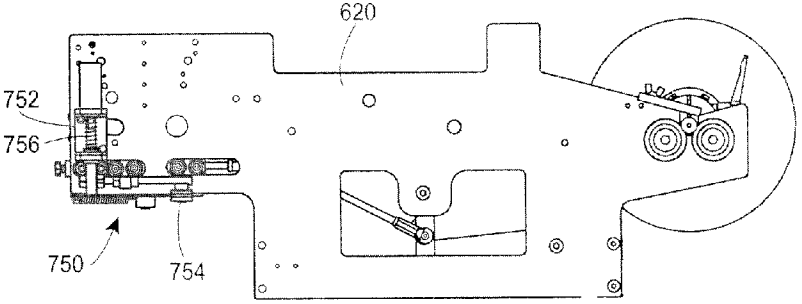
FIGS. 17A and 17 B are isometric and side views, respectively, of a bag separation assembly of the ice bagger of FIG. 9.
Figure 17A:
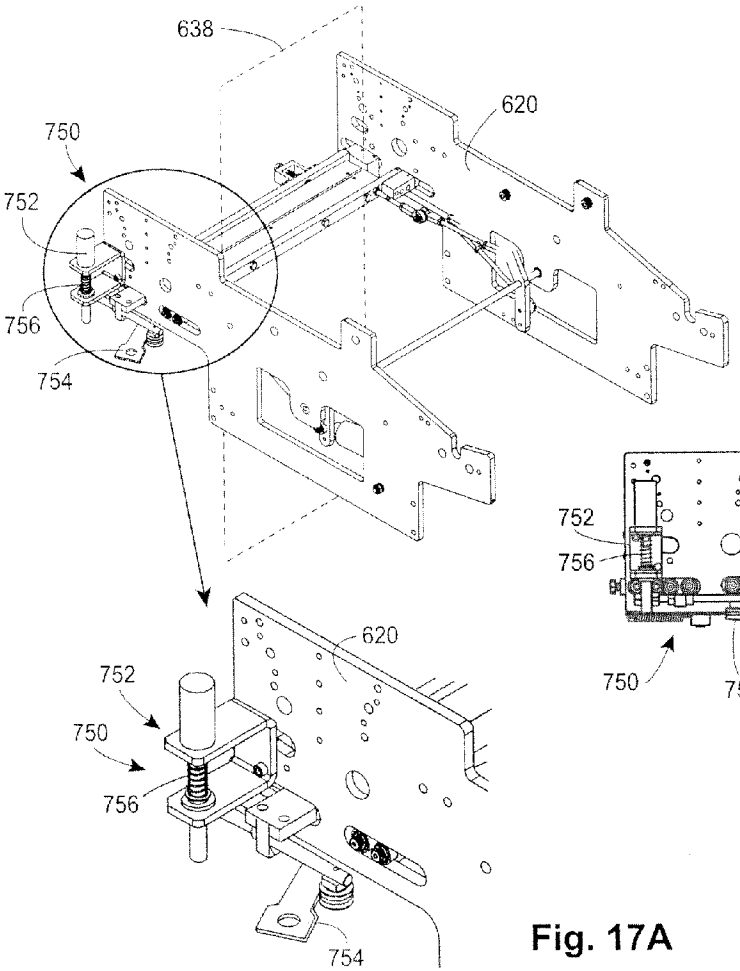
Figure 18A:
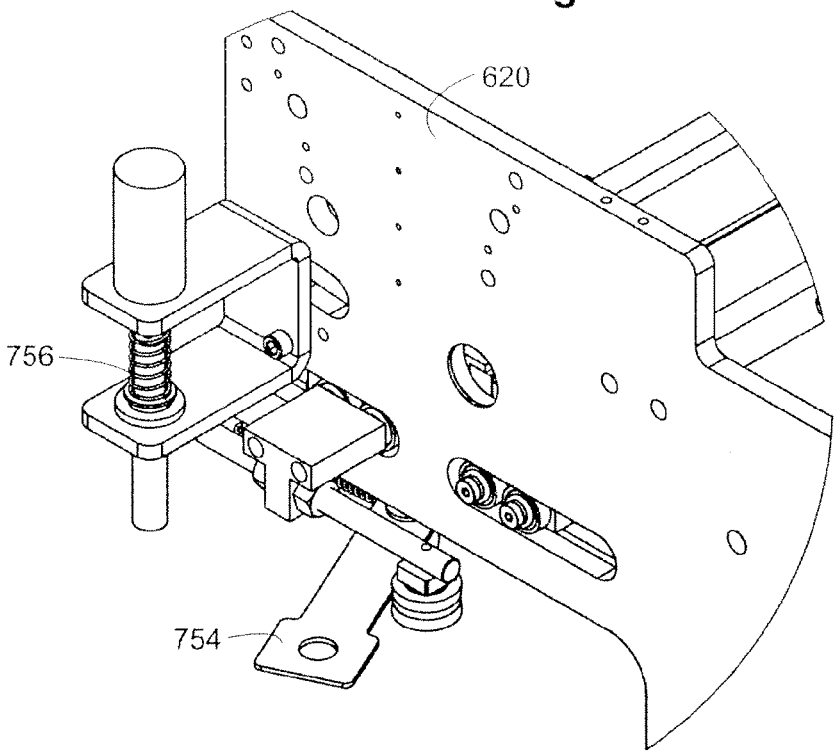
FIGS. 18A-18D are isometric, side elevational, end, and top plan views of a bag tearing assembly of the ice bagger of FIGS. 17A and 17B.
Figure 18B:
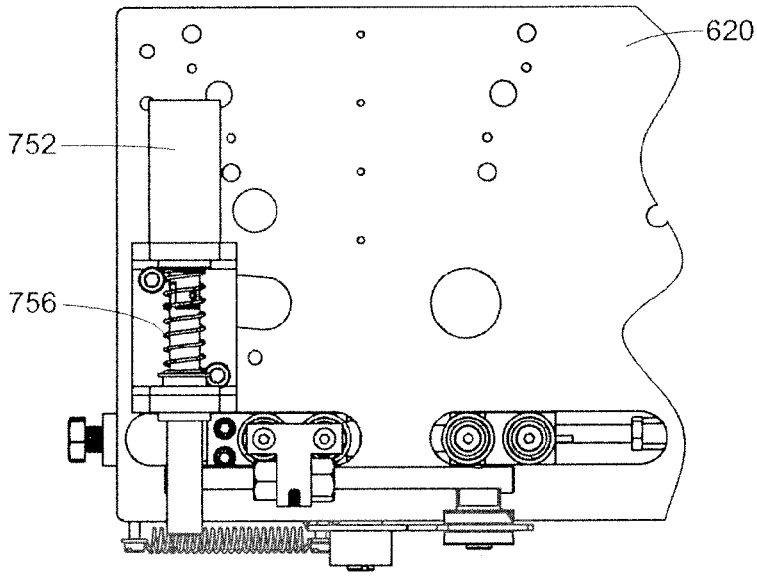
Figure 18C:
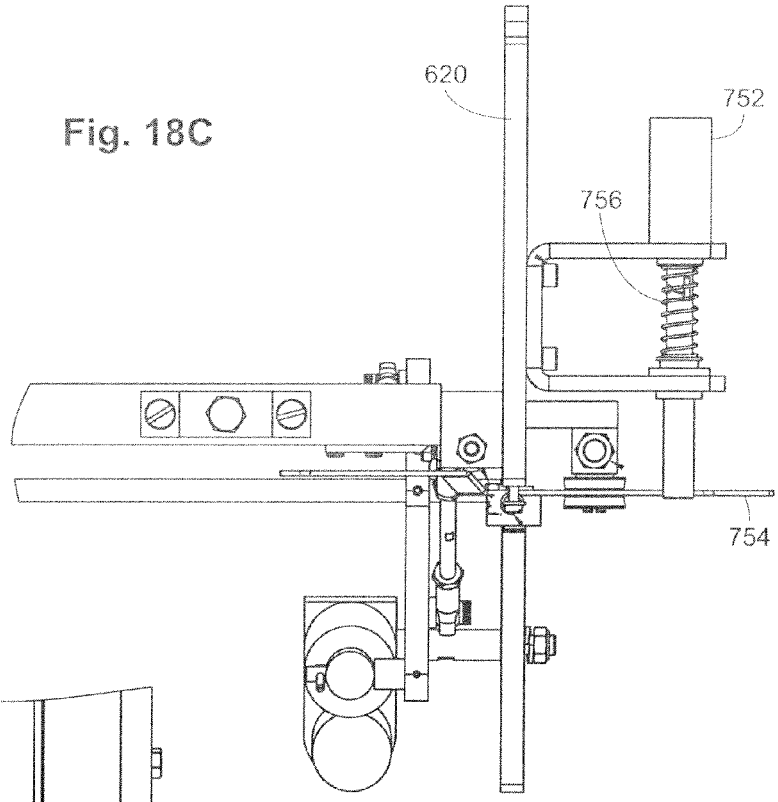
Figure 18D:
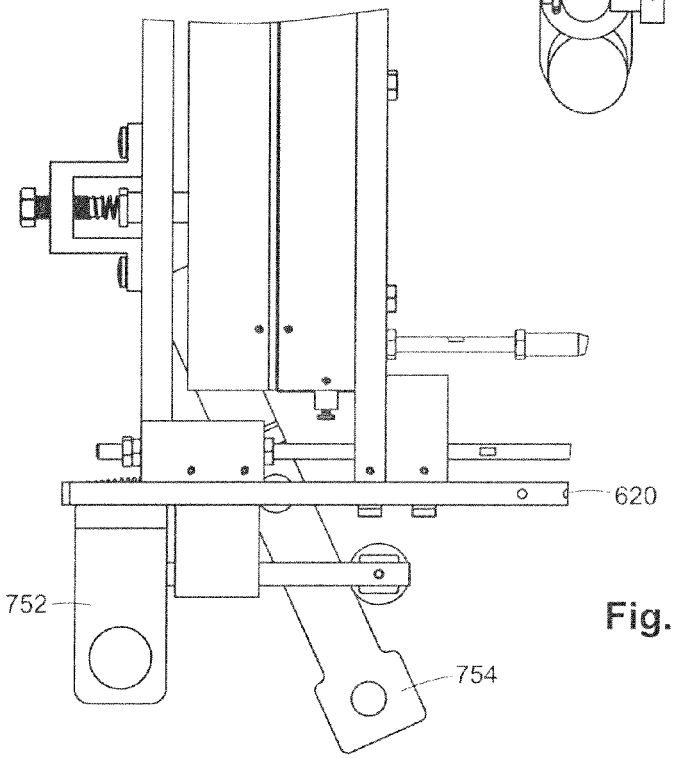
Figure 19A:
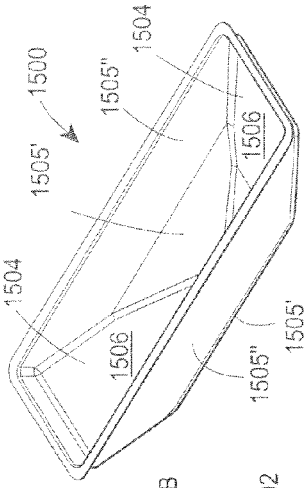
FIGS. 19A-19D illustrate an alternate embodiment of a hopper.
Figure 19D:
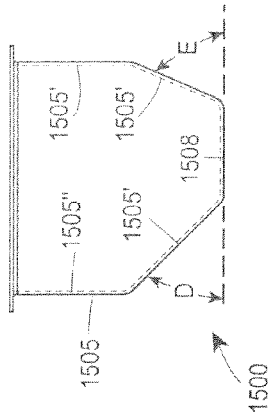
Figure 19C:
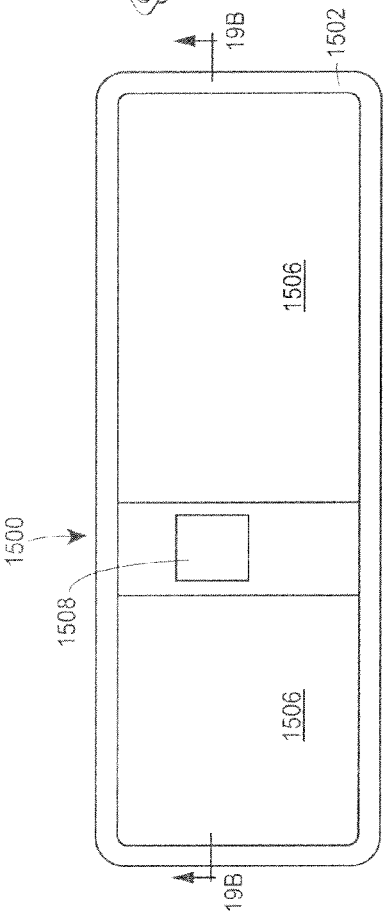
Figure 19B:
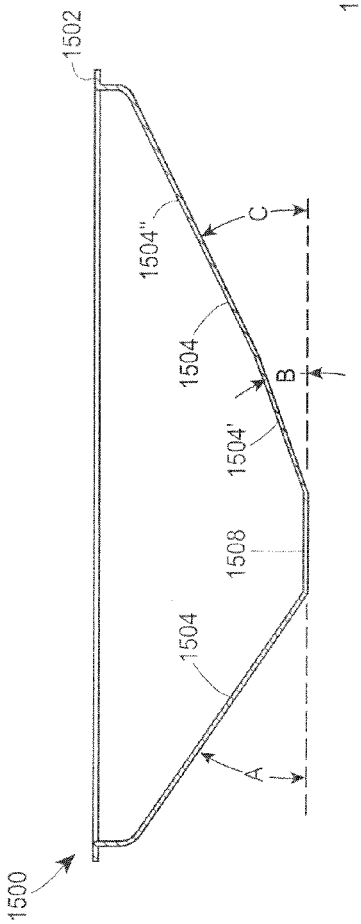

As illustrated in FIGS. 17A and 17B, the bag separation mechanism 750 is located on the bagger frame 620, near the sealing jaw assembly 618. The bag separation mechanism 750 includes an actuator 752, such as a solenoid, and a separator bar 754. The actuator 752 may include a biasing member, such as a spring 756, which pre-loads the actuator bar 754. Once the actuator 752 initiates bag separation, the actuator bar 754 is released from a pre-loaded position, and moves to an un-loaded position. Because the actuator bar 754 is pivotably mounted to the frame 620, one end of the actuator bar 754 swings through part of the sheet of ice bags 638 near a perforated portion. The perforated portion of the sheet of ice bags 638 separates individual bags from one another. After the actuator bar 754 swings through the perforated portion, the weight of the ice bag will continue to tear the sheet along the perforation until the individual ice bag separates from the sheet.

FIGS. 19A-19D illustrate an alternate embodiment of the hopper 1500. In one embodiment, the hopper 1500 may be approximately 60 cm long by approximately 20 cm wide. The alternate hopper 1500 may include a pair of angled bottom walls 1504 having slider surfaces 1506 that direct ice into the ice exit 1508. The ice exit 1508 is advantageously located off center both laterally and longitudinally to improve ice delivery. The bottom walls 1504 may be angled with respect to the upper lip 1502. One bottom wall 1504 may include an angle A in the range of between approximately 15 degrees and approximately 45 degrees, preferably between approximately 20 degrees and approximately 40 degrees, and more preferably between approximately 30 degrees and approximately 35 degrees. Another bottom wall 1504 may include a lower portion 1504' and an upper portion 1504". The lower portion 1504' may include an angle B with respect to the upper lip 1502 in the range of between approximately 5 degrees and approximately 30 degrees, preferably between approximately 10 degrees and approximately 25 degrees, and more preferably between approximately 15 degrees and approximately 20 degrees. The upper portion 1504" may include an angle C with respect to the upper lip 1502 in the range of between approximately 10 degrees and approximately 40 degrees, preferably between approximately 15 degrees and approximately 35 degrees, and more preferably between approximately 20 degrees and approximately 30 degrees. The hopper 1500 may also include side walls 1505 having a lower side portion 1505' and an upper side portion 1505". The upper side portion 1505" may be approximately perpendicular to the upper lip 1502, while one lower side portion 1505' may include an angle D with respect to the upper lip 1502 in the range of approximately 25 degrees to approximately 60 degrees, preferably between approximately 30 degrees and approximately 55 degrees, and more preferably between approximately 40 degrees and approximately 45 degrees. The other lower side portion 1505' may include an angle E with respect to the upper lip 1502 in the range of between approximately 50 degrees and approximately 75 degrees, preferably between approximately 55 degrees and approximately 70 degrees, and more preferably between approximately 60 degrees and approximately 65 degrees. The relative angles of the walls of the hopper 1500 result in more efficient ice delivery to the ice door 1508 with less jamming of the ice in the hopper 1500.

Figure 20:
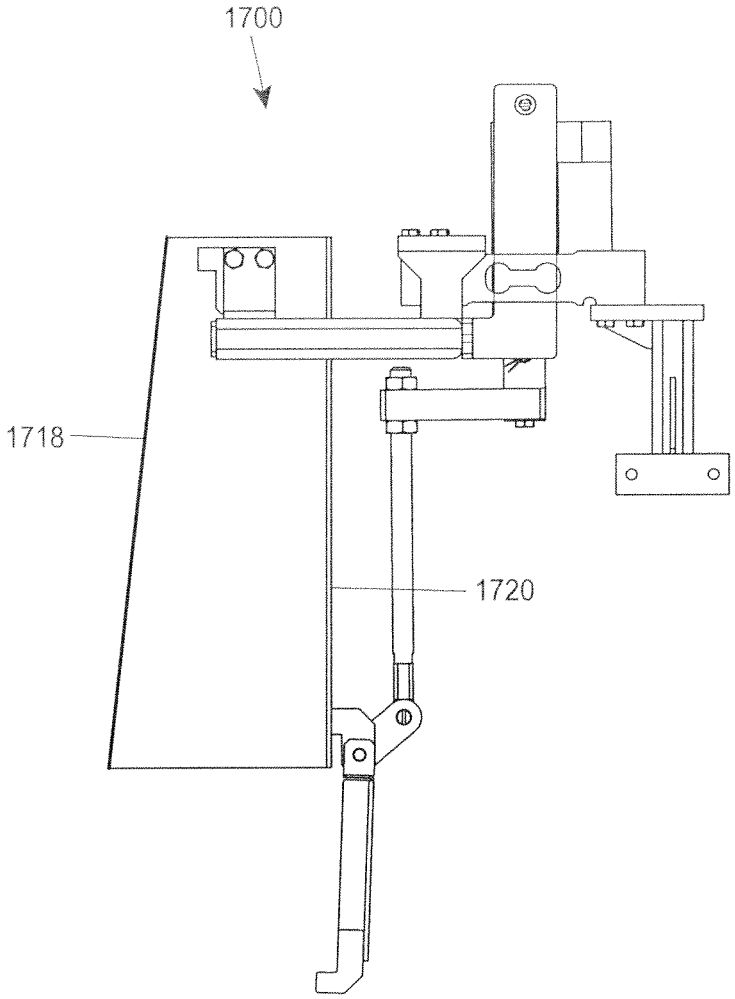
FIG. 20 illustrates an alternate embodiment of a retention bin.

FIG. 20 illustrates a side view of an alternate embodiment of the retention bin 1700. The retention bin 1700 of FIG. 20 differs from the retention bin 700 of FIGS. 15 and 16 in that the front wall 1718 is angled with respect to the rear wall 1720. In other words, the front wall 1718 is not parallel to the rear wall 1720. The front wall 1718 flares outwardly, away from the rear wall 1720 from top to bottom causing the retention bin 1700 to have a smaller upper opening than a lower opening. This outward flare prevents bags of ice from becoming frictionally locked in the retention bin as the bag fills with ice. The angle between the front wall 1718 and the rear wall 1720 may be in the range of approximately 10 degrees to approximately 30 degrees.

Returning now to FIGS. 9 and 10, one embodiment of an ice bagging sequence will be described. A sheet of ice bags 638 is disposed on the bagging roll 622. The sheet of ice bags 638 is threaded through one or more guide rollers 624 and into the pinch roller assembly 614. After passing through the pinch roller assembly 614, the sheet of ice bags 638 passes through the sealing jaw assembly 618 and into the basket and release assembly 700. The pinch roller wheels 644', 644" rotate to draw the sheet of ice bags 638 through the ice bagger 600. The sheet of ice bags 638 may be optically marked so that an optical sensor reads the optical mark and sends a signal to the controller indicating a position of the sheet of ice bags 638 within the ice bagger. When the controller determines that the sheet of ice bags 638 is positioned with an individual bag opening and perforation at or slightly above the pinch roller assembly 614, the controller sends a signal to the pinch roller assembly 614 to stop rotation of the pinch roller wheels 644', 644". After the pinch roller wheels 644', 644" stop rotation, the pinch roller wheels 644', 644" move axially inward, thereby forcing two plies of the ice bag apart from one another at the bag opening. Opening of the bag may be aided by air flow from the blower assembly. After the pinch roller wheels 644', 644" move axially inward, the controller sends a signal to the actuator 650 of the finger assembly 612 so that the finger plates 646 pivot placing distal ends 654 of the finger plates 646 into the bag opening.

After the finger plates 646 rotate, the controller sends a signal to the hopper 500 to open the ice door 510. As the ice door 510 opens, ice slides down the slide surfaces 506 and into the ice exit 508. Ice then passes through the ice chute 511, between the finger plates 646 and into the ice bag through the ice bag opening. As ice fills the ice bag in the basket and release assembly 700, the load cell 714 sends a signal to the controller that represents the weight of ice in the ice bag. When the controller determines that a predetermined amount of ice is in the ice bag, the controller sends a signal to the hopper 500 to close the ice door 510, thereby stopping the flow of ice into the ice bag.

After the flow of ice stops (i.e., the ice door 510 is closed), the controller sends a signal to the pinch roller assembly 614 to move the pinch roller wheels 644', 644" axially outward to close the ice bag opening. Subsequently, the controller sends a signal to the actuator 660 of the sealing jaw assembly 618 to close the sealing jaws 658, thereby sealing the bag opening. Once the ice bag is sealed and the sealing jaws 658 open, the pinch roller wheels 644', 644" rotate to advance the sheet of ice bags 638 until a perforation in the sheet of ice bags 638 is aligned with the bag separation mechanism 750. Once the perforation is aligned with the bag separation mechanism 750, the controller sends a signal to the actuator 730 of the bag and release assembly 700 to open the bottom door 724. Once the bottom door 724 is opened, the ice bag hangs from the sheet of ice bags 638. The controller then sends a signal to the actuator 752 of the bag separation mechanism 750 to release the separator bar 754, which pivots through the perforation, thereby separating the filled ice bag from the sheet of ice bags 638. The filled ice bag then falls through the open end of the retention bin 716 and into the ice storage unit 400, for example.

In one example, the ice bagging system 100 may be programmed to fill ice bags with various amounts of ice. For example, the ice bagging system may be programmed to fill 5 lb, 7 lb, 10 lb, 15 lb, and 20 lb, bags of ice. The controller allows a user to program the ice bagging system 100 to accommodate virtually any amount of ice or size of ice bag to be filled.

The disclosed ice bagging system advantageously provides faster ice bagging, less ice spillage during bagging, and more precise ice quantity management over prior art ice bagging systems. Moreover, the disclosed ice bagging system may be easily customized to particular locations or operations. For example, different combinations of ice making units, ice bagging units, and/or ice storage units may be interchanged with one another to provide different capabilities or to customize the ice bagging system to a particular operation. The disclosed ice bagging system may be programmed to produce ice bags having customized, or different, amounts of ice from a single sheet of ice bags. For example, the disclosed ice bagging system may include an input device, such as a touch screen, that allows a customer to select the amount of ice to be bagged. Thus, the disclosed ice bagging system is a fully integrated, stand-alone, ice bagging system particularly well suited for retail operations.

As used herein, the term "approximately," when modifying an angle, contemplates an angle within 5 degrees higher or lower than the modified numerical angle value. Similarly, when modifying "perpendicular", "approximately" contemplates an angle within the range of 85 degrees to 95 degrees.

Although certain ice bagging systems have been described herein in accordance with the teachings of the present disclosure, the scope of the appended claims is not limited thereto. On the contrary, the claims cover all embodiments of the teachings of this disclosure that fairly fall within the scope of permissible equivalents.

What is claimed is:

1. An ice bagging unit for an ice bagging system comprising an ice maker unit and an ice storing unit, the ice bagging unit comprising:

a hopper, an ice bagger fluidly attached to the hopper, and a basket and release assembly operatively connected to the ice bagger;

wherein the ice bagger includes and a pinch roller assembly, the pinch roller assembly including a pinch roller wheel that is axially movably inwardly and outwardly along an axle of the pinch roller assembly.

2. The ice bagging unit of claim 1, wherein the basket and release assembly includes a retention bin.

3. The ice bagging unit of claim 2, wherein the retention bin includes a rear wall, a pair of side walls, and a front wall, the front wall being pivotably mounted to the pair of side walls.

4. The ice bagging unit of claim 3, wherein the retention bin further includes a bottom door, the bottom door being pivotably mounted to the rear wall.

5. The ice bagging unit of claim 2, wherein the retention bin includes a rear wall, a pair of side walls, and a front wall, the front wall angling outward from top to bottom resulting in the retention bin having a smaller upper opening than a lower opening.

6. The ice bagging unit of claim 1, wherein the basket and release assembly includes a load cell for measuring a weight of ice within a bag, the load cell transmitting a signal to a controller indicative of a weight of ice in the retention bin.

7. The ice bagging unit of claim 1, wherein the hopper includes an ice exit and an ice door, the ice door being movable to selectively open and close the ice exit, the ice exit being at least partially surrounded by a gap for collecting melted ice water before the melted ice water enters the ice exit.

8. The ice bagging unit of claim 1, wherein the ice bagger includes a movable means connected to a frame of the ice bagging system.

9. The ice bagging unit of claim 1, wherein the hopper includes a movable means connected to a frame of the ice bagging system.

10. The ice bagging unit of claim 1, further comprising a finger assembly, wherein the finger assembly comprises a pair of finger plates pivotably mounted to one or more rods.

11. The ice bagging unit of claim 10, wherein the finger plates pivot into an opening in a bag when a bag is held by the pinch roller assembly, at least a portion of the finger plates extending into the bag and protecting a sealing area of the bag from moisture when ice is poured into the bag.

12. The ice bagging unit of claim 10, wherein one finger plate rotates in an opposite direction of another finger plate.

13. The ice bagging unit of claim 1, wherein the ice bagger includes a bag roll assembly, the bag roll assembly having a bag roll mounted to a frame.

14. The ice bagging unit of claim 13, wherein the bag roll assembly includes a brake bar for the bag roll.

15. The ice bagging unit of claim 14, wherein the brake bar is concavely shaped.

16. The ice bagging unit of claim 1, wherein the ice bagger includes a bag separation mechanism, the bag separation mechanism including an actuator and a separator bar.

17. The ice bagging unit of claim 1, wherein the hopper receives ice from a plurality of cubers.

18. The ice bagging unit of claim 1, wherein throughput of the ice bagging unit is adjustable.

* * * * *